US010467874B2

(12) United States Patent
Fischer et al.

(10) Patent No.: US 10,467,874 B2
(45) Date of Patent: Nov. 5, 2019

(54) FIRE DETECTOR HAVING A PHOTODIODE FOR SENSING AMBIENT LIGHT

(71) Applicant: Siemens Schweiz AG, Zürich (CH)

(72) Inventors: Martin Fischer, Bülach (CH); Thomas Rohrer, Sachseln (CH)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 16/300,600

(22) PCT Filed: May 3, 2017

(86) PCT No.: PCT/EP2017/060526

§ 371 (c)(1),
(2) Date: Nov. 12, 2018

(87) PCT Pub. No.: WO2017/194367

PCT Pub. Date: Nov. 16, 2017

(65) Prior Publication Data

US 2019/0180590 A1 Jun. 13, 2019

(30) Foreign Application Priority Data

May 13, 2016 (DE) ..... 10 2016 208 357
May 13, 2016 (DE) ..... 10 2016 208 358
May 13, 2016 (DE) ..... 10 2016 208 359

(51) Int. Cl.
*G08B 17/12* (2006.01)
*G08B 17/103* (2006.01)
(Continued)

(52) U.S. Cl.
CPC ..... *G08B 17/103* (2013.01); *G08B 17/107* (2013.01); *G08B 17/12* (2013.01); *G08B 29/183* (2013.01)

(58) Field of Classification Search
CPC .... G08B 17/103; G08B 17/107; G08B 17/12; G08B 29/183
(Continued)

(56) References Cited

U.S. PATENT DOCUMENTS 4,491,406 A * 1/1985 Johnson ..... G03B 15/05 396/168
5,995,008 A * 11/1999 King ..... G08B 17/12 340/578
(Continued)

FOREIGN PATENT DOCUMENTS

DE 10 2011 083 455 A1 9/2012 ..... G01N 21/958
EP 1 039 426 A2 9/2000 ..... G08B 17/107
(Continued)

OTHER PUBLICATIONS

International Search Report and Written Opinion, Application No. PCT/EP2017/060526, 18 pages, dated Aug. 22, 2017.

*Primary Examiner* — Kerri L McNally
*Assistant Examiner* — Thang D Tran
(74) *Attorney, Agent, or Firm* — Slayden Grubert Beard PLLC

(57) ABSTRACT

Various embodiments may include fire detector comprising: a fire sensor generating a signal corresponding to a characteristic fire parameter; a control unit; and a photodiode for detecting ambient light in a spectrally delimited range of 400 nm to 1150 nm. The control unit analyzes the signal and generates a fire alarm if the signal corresponds to a predetermined threshold for a fire. The control unit analyzes a photo-signal received from the photodiode and if the flicker frequencies characteristic of open fire are detected, the control unit increases a sampling rate for acquiring the
(Continued)

sensor signal from the fire sensor by reducing a filter time of an evaluation filter for the fire analysis and/or by lowering an alerting threshold.

17 Claims, 11 Drawing Sheets

(51) Int. Cl.
*G08B 17/107* (2006.01)
*G08B 29/18* (2006.01)

(58) Field of Classification Search
USPC ..... 340/577
See application file for complete search history.

(56) References Cited

U.S. PATENT DOCUMENTS 9,179,105 B1* 11/2015 Zeira ..... H04N 5/2254
10,097,814 B2 10/2018 Hanses et al.
2002/0109096 A1* 8/2002 Carter ..... G08B 17/12 250/339.15
2005/0104089 A1* 5/2005 Engelmann ..... H04N 5/3651 257/204
2008/0272921 A1* 11/2008 Cole ..... G08B 13/19602 340/577
2009/0315722 A1* 12/2009 Hou ..... G08B 17/125 340/578
2010/0289650 A1 11/2010 Dittmer et al. ..... 340/578
2011/0057805 A1 3/2011 Loepfe et al. ..... 340/628
2012/0298867 A1* 11/2012 Nishikawa ..... G01J 5/0014 250/338.3
2014/0022385 A1 1/2014 Fischer ..... 348/143
2014/0369031 A1* 12/2014 Livesay ..... H01L 33/642 362/147
2015/0029320 A1* 1/2015 Wieser ..... G08B 13/248 348/77
2016/0141322 A1* 5/2016 Gokingco ..... H01L 27/14621 250/226

FOREIGN PATENT DOCUMENTS

EP 2 093 734 A1 8/2009 ..... G08B 17/107
EP 2 251 846 A1 11/2010 ..... G08B 17/12
EP 2 688 274 A1 1/2014 ..... G08B 17/10
EP 2 690 611 A2 1/2014 ..... G08B 17/12
WO 2010/100288 A1 9/2010 ..... H05B 33/08
WO 2017/194367 A1 11/2017 ..... G08B 17/107

* cited by examiner

FIRE DETECTOR HAVING A PHOTODIODE FOR SENSING AMBIENT LIGHT

CROSS-REFERENCE TO RELATED APPLICATIONS

This application is a U.S. National Stage Application of International Application No. PCT/EP2017/060526 filed May 3, 2017, which designates the United States of America, and claims priority to DE Application No. 10 2016 208 359.7 filed May 13, 2016, DE Application No. 10 2016 208 358.9 filed May 13, 2016, and DE Application No. 10 2016 208 357.0 filed May 13, 2016 the contents of which are hereby incorporated by reference in their entirety.

TECHNICAL FIELD

The present disclosure relates to fire detectors. Various embodiments may include an open light-scattering smoke detector, a closed light-scattering smoke detector, and/or a thermal detector.

BACKGROUND

Fire sensor may include a light transmitter and light receiver in a light-scattering arrangement having a light-scattering center located in the open outside the light-scattering smoke detector. The fire sensor may also be an optical measuring chamber that is arranged in a detector housing, is shielded from ambient light and is permeable to smoke to be detected. In addition, the fire sensor can comprise one or more temperature sensors. Such a temperature sensor may be, for example, a temperature-dependent resistor (thermistor), for instance what is known as an NTC or PTC, or a non-contact temperature sensor comprising a thermopile or microbolometer.

A fire detector typically also comprises a control unit, preferably a microcontroller. The control unit analyzes a sensor signal received from the fire sensor for at least one characteristic fire parameter, to evaluate said signal and to output a fire alarm on a fire being detected. A characteristic fire parameter may include, for a light-scattering smoke detector, exceeding a minimum scattered-light level which correlates to a smoke-particle concentration. Alternatively or additionally, an inadmissibly high rise in level of the scattered light may also be a characteristic fire parameter. In the case of a thermal detector, a characteristic fire parameter may include exceeding a minimum temperature in the (immediate) surroundings of the fire detector, for instance a temperature of at least 60° C., 65°, 70° C. or 75° C. Alternatively or additionally, a characteristic fire parameter may also be an inadmissibly high rise in temperature, for instance of at least 5° C. per minute or at least 10° C. per minute.

EP 2093734 A1 and EP 1039426 A2, for example, disclose open light-scattering smoke detectors. In addition, flame detectors are known from the prior art, for instance as disclosed by DE 10 2011 083 455 A1 or EP 2 251 846 A1. Such flame detectors are configured specifically for detecting open fire and for emitting an alarm in less than one second. They comprise usually two or more pyroelectric sensors as radiation sensors. Such sensors are tuned to detect characteristic flicker frequencies of open fire, i.e. flames and glowing embers, in the infrared region and, if applicable, in the visible and ultraviolet region. The flicker frequencies typically lie in a range of 2 Hz to 20 Hz.

EP 1039426 A2 discloses a smartphone having a fire-detector application comprising suitable program steps for analyzing video image data captured by an internal camera with regard to at least one piece of information characteristic of fire, and if said information is present, to output an alarm via an output unit. This smartphone is also configured to analyze the received video signal for the presence of flicker frequencies characteristic of open fire, and if there is a significant difference in two successive video images, to switch from a first, low image refresh rate to a second, high image refresh rate.

The infrared pyroelectric sensors are typically sensitive to infrared radiation in the wavelength range of 4.0 to 4.8 μm. This specific radiation is produced in the combustion of carbon and hydrocarbons. An example pyroelectric sensor is sensitive to characteristic emissions of metal fires in the UV region. For use in the open, flame detectors may also comprise a radiation sensor that is sensitive to infrared radiation in the wavelength range of 5.1 to 6.0 μm. This radiation is primarily parasitic radiation such as, for instance, infrared radiation from hot bodies or sunlight. A more reliable assessment, i.e. whether or not it is an open fire, is possible on the basis of all the sensor signals.

SUMMARY

The teachings of the present disclosure may enable a fire detector which, using little additional technical complexity, gives an alarm more quickly and, in particular, more reliably. For example, a fire detector, in particular an open light-scattering smoke detector, may include a fire sensor, comprising a control unit (4) and comprising a photodiode (6, 6') for detecting ambient light in a spectrally delimited range of 400 nm to 1150 nm, wherein the control unit (4) is configured to analyze a sensor signal (BS) received from the fire sensor for at least one characteristic fire parameter, to evaluate said signal and to output a fire alarm (AL) on a fire being detected, and wherein the control unit (4) is also configured to analyze a photo-signal (PD) received from the photodiode (6, 6') for the presence of flicker frequencies characteristic of open fire, and on the basis thereof, to output a potential fire alarm (AL) more quickly by increasing a sampling rate for acquiring the sensor signal (BS) from the fire sensor (5), by reducing a filter time ($T_{Filter}$), in particular a time constant, of an evaluation filter (41) for the fire analysis and/or by lowering an alerting threshold (LEV).

In some embodiments, the control unit (4) is configured to suppress the output of a potential fire alarm (AL) solely on the basis of detected characteristic flicker frequencies in the received photo-signal (PD).

In some embodiments, the photodiode (6, 6') is a silicon photodiode.

In some embodiments, a daylight blocking filter that passes only light in a range of 700 nm to 1150 nm, in particular 730 nm to 1100 nm, is arranged in front of the photodiode (6, 6').

In some embodiments, the fire detector is an open light-scattering smoke detector, wherein the light-scattering smoke detector comprises a housing (2), a circuit mount (3), a light transmitter (S) and a light receiver (E), wherein the light transmitter (S) and the light receiver (E) are arranged in the housing (2), wherein the light transmitter (S) and the light receiver (E) are arranged in a light-scattering arrangement (SA) having a light-scattering center (SZ) located outside the light-scattering smoke detector, wherein the light-scattering arrangement (SA) forms the fire sensor with the light transmitter (S) and the light receiver (E), and wherein the control unit (4) is configured to analyze a scattered-light signal received from the fire sensor as the sensor signal (BS) for an inadmissibly high signal level as a fire parameter and/or for an inadmissibly high rate of rise of the sensor signal (BS) as another fire parameter, and to output a fire alarm (AL) in the event of a fire being detected.

In some embodiments, the light receiver (E) for the scattered-light detection and the photodiode (6) for the ambient-light sensing are implemented as a common photodiode (6').

In some embodiments, the control unit (4) is configured to analyze in time-separated phases the scattered-light signal/photo-signal (BS, PD) received from the common photodiode (6'), wherein the control unit (4) is configured to analyze the received scattered-light signal/photo-signal (BS, PD) in a particular first phase for an inadmissibly high signal level and/or for an inadmissibly high rate of rise, and is configured to analyze the received scattered-light signal/photo-signal (BS, PD) in a particular second phase for the presence of characteristic flicker frequencies.

In some embodiments, the control unit (4) is configured to determine a first DC component (OFFSET) from the received scattered-light signal/photo-signal (BS, PD), and is also configured to subtract this first DC component (OFFSET) from the received scattered-light signal/photo-signal (BS, PD) in order to obtain a scattered-light signal/photo-signal (AC) that contains substantially no DC component.

In some embodiments, the control unit (4) is configured to compare the determined first DC component (OFFSET) with a specified overdrive value, and to output a fault signal (ST) if the determined first DC component (OFFSET) exceeds the overdrive value for a specified minimum time.

In some embodiments, the control unit (4) is configured to determine a second DC component (H/D) from the received scattered-light signal/photo-signal (BS, PD), which component represents the long-term average of a brightness value, and wherein the control unit (4) is also configured to monitor whether this second DC component (H/D) falls below a minimum brightness level, and on the basis thereof, to lower an alerting threshold (LEV) for the output of a potential fire alarm (AL).

In some embodiments, the fire detector is a light-scattering smoke detector that comprises as a fire sensor an optical measuring chamber (10) that is arranged in a detector housing (2), is shielded from ambient light and is permeable to smoke to be detected, wherein the control unit (4) is configured to analyze a scattered-light signal received from the optical measuring chamber (10) as the sensor signal (BS) for an inadmissibly high signal level as a fire parameter and/or for an inadmissibly high rate of rise of the sensor signal (BS) as another fire parameter, and to output a fire alarm (AL) in the event of a fire being detected.

In some embodiments, the fire detector comprises a temperature sensor (5), in particular a thermistor, for sensing an ambient temperature (UT) in the region immediately around the fire detector, and wherein the control unit (4) is configured to include the sensed ambient temperature (UT) in the fire analysis.

In some embodiments, the fire detector is a sole thermal detector comprising a temperature sensor (5) as the fire sensor, wherein the control unit (4) is configured to analyze a temperature signal received from the temperature sensor (5) as the sensor signal (BS) for an inadmissibly high ambient temperature (UT) as a fire parameter and/or for an inadmissibly high temperature rise as another fire parameter, and to output a fire alarm (AL) in the event of a fire being detected.

In some embodiments, the temperature sensor (5) is a non-contact temperature sensor, which comprises a thermal radiation sensor sensitive to thermal radiation (W) in the infrared region, in particular a thermopile or a microbolometer, wherein the fire detector comprises a detector housing (2) having a detector cover (22), wherein the thermal radiation sensor (6) is arranged in the detector housing (2), and for the purpose of deriving by calculation the ambient temperature (UT), is oriented optically towards the internal face (IS) of the detector cover (22), and wherein the detector cover (22) in the region of the internal face (IS) is designed for thermal conduction with an opposite region of the external face of the detector cover (22) such that the housing temperature (T) that arises on the internal face (IS) tracks the ambient temperature (UT) on the opposite region of the detector cover (22).

In some embodiments, the control unit (4) is configured to lower an alerting threshold (LEV) for the output of a potential fire alarm (AL) in order to output a potential fire alarm (AL) more quickly if the presence of flicker frequencies characteristic of open fire has been detected.

In some embodiments, the control unit (4) is also configured to monitor whether the photo-signal (PD) output by the photodiode (6) falls below a minimum brightness level, and is configured to lower an alerting threshold (LEV) for the output of a potential fire alarm (AL).

In some embodiments, the fire detector has a wired or wireless connection to a higher-level control center, and wherein the control unit (4) is configured to output to the control center whether the brightness is above or below the minimum brightness level as a day/night identifier (T/N).

BRIEF DESCRIPTION OF THE DRAWINGS

The teaching of the present disclosure are described with reference to the figures by way of example, in which.

DETAILED DESCRIPTION

Figure 1:
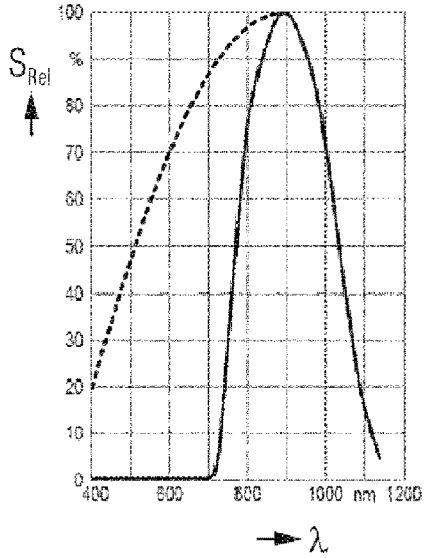
FIG. 1 shows a spectral characteristic curve of a silicon photodiode with and without daylight filter arranged in front.

In some embodiments, the fire detector comprises a photodiode for sensing ambient light in a spectrally delimited range of 400 nm to 1150 nm, i.e. ambient light in the optically visible region and in the adjacent near-UV and infrared regions. The control unit is also configured to analyze a photo-signal received from the photodiode for the presence of flicker frequencies characteristic of open fire, and on the basis thereof, to output more quickly a potential fire alarm by increasing a sampling rate for acquiring the sensor signal from the fire sensor, by reducing a filter time of an evaluation filter for the fire analysis and/or by lowering an alerting threshold. In some embodiments, the filter time is a time constant or an integration time.

Some embodiments include a low-cost photodiode as a "mini flame detector" that nonetheless has an informative value of sufficient quality and justifies outputting a fire alarm more quickly in the event that flicker frequencies are detected as indication of the presence of a fire. In some embodiments, a fire alarm can be output more quickly because a fire situation can be assumed with greater probability. This is the case when the characteristic flicker frequencies are detected for a minimum time, for instance a time of 2, 5 or 10 seconds. This does not mean, however, that an alarm is given after this minimum time. This is because the photodiode signal must be considered far too mediocre in quality compared with the sensor signals from the spectrally tightly-delimited pyroelectric sensors in conjunction with complex, powerful signal processing.

Instead, the fire-sensor signal, such as the scattered-light signal, for instance, is processed more quickly, which otherwise being associated with a greater likelihood of false alarms is avoided. In other words, on detecting characteristic flicker frequencies, the fire sensor responds more sensitively and more quickly, but because of the high probability of a subsequent rise in the scattered-light level occurring as a result of a fire, this is acceptable. If in the example case of the open light-scattering arrangement as fire sensor, an "expected" level rise then fails to materialize, then no fire alarm is given.

By increasing the sampling rate for acquiring the fire-sensor signal, for instance such as a scattered-light signal/photo-signal or a temperature sensor signal, a rise in this fire-sensor signal can be detected more quickly and hence also a fire alarm can be output more quickly. Reducing the filter time means than the evaluation filter responds more quickly. Since the probability of an occurring fire event is assumed to be high or higher than otherwise on detecting the flicker frequencies, then a fire alarm can be output more quickly to the benefit of safety. The acquired, in some cases digitized, sensor signal from the fire sensor is input to the evaluation filter, e.g., a digital filter implemented as a software program and executed by the microcontroller as a control unit. The digital filter may include a low-pass filter or what is known as a sliding filter. This filter performs a certain degree of averaging of the acquired sensor-signal values, so that a fire alarm is not output immediately on detecting a fire. Instead, there is a wait to determine whether this event is present repeatedly in succession rather than sporadically, in order to ovoid outputting a false alarm. Lowering the alerting threshold means that the fire detector is switched more sensitively, so to speak, and less robustly. It means that the alerting threshold is advantageously reached more quickly, and hence the fire alarm is output more quickly.

In some embodiments, the higher the level of the detected flicker frequencies, the more quickly a potential fire alarm is output. The output can be accelerated proportionally, progressively or degressively as a function of the flicker frequency level. In some embodiments, it can be accelerated only once a minimum detection level has been exceeded.

In some embodiments, the photodiode comprises a silicon photodiode and in particular a silicon PIN photodiode. A daylight blocking filter that passes only light in a range of 700 nm to 1150 nm, in particular 730 nm to 1100 nm, can be arranged in front of same. Integrating such a photodiode in a fire detector hence adds very little in cost and in circuit complexity.

Connected after the photodiode may be a transimpedance amplifier or a transimpedance converter, which converts the photo-current produced by the photodiode into a measurement voltage proportional thereto. The photo-current is itself proportional to the received luminous flux. Optical interference such as the flickering of fluorescent tubes or incident sunlight can thereby be reduced advantageously. A photodiode of this type, for instance such as from the OSRAM company (type BPW 34 FAS), is available at especially low cost compared with a pyroelectric sensor.

In some embodiments, the control unit is configured to suppress or inhibit the output of a potential fire alarm solely on the basis of detected characteristic flicker frequencies in the received photo-signal. In other words, the control unit at least must have detected the presence of a characteristic fire parameter in the sensor signal received from the fire sensor. The output of a potential false alarm is thereby inhibited should the actual fire sensor subsequently not detect the expected fire incident. This is the case, for instance, if flickering candle light is detected by the photodiode as open fire but this does not result in an appreciable increase in the scattered-light level in the surroundings of the fire detector, in the optical measuring chamber of the fire detector, or this does not result in an appreciable temperature rise in the surroundings of the fire detector.

In some embodiments, the fire detector is an open light-scattering smoke detector. The latter comprises a housing, a circuit mount and a light transmitter and a light receiver. The light transmitter and the light receiver are arranged in the housing. In addition, the light transmitter and the light receiver are arranged in a light-scattering arrangement having a light-scattering center located outside the light-scattering smoke detector, in particular in the open. The light-scattering arrangement forms the fire sensor with the light transmitter and the light receiver. The control unit is configured to analyze a scattered-light signal received from the fire sensor, which signal forms the sensor signal, for an inadmissibly high signal level as a fire parameter and/or for an inadmissibly high rate of rise of the sensor signal as another fire parameter. The light transmitter and the light receiver may be arranged on the circuit mount. The latter may be accommodated in the housing of the light-scattering smoke detector.

In some embodiments, the light receiver for the optical scattered-light detection and the photodiode for sensing ambient light comprise a common photodiode, using a single photodiode both for the scattered-light detection and for the flame detection. This simplifies the design of the fire detector. It is also cheaper to produce.

In some embodiments, the control unit is configured to analyze in time-separated phases the scattered-light signal/photo-signal received from the common photodiode. For this purpose, the control unit is configured to analyze the received scattered-light signal/photo-signal in a particular first phase for an inadmissibly high signal level and/or for an inadmissibly high rate of rise. It may be configured to analyze the received scattered-light signal/photo-signal in a particular second phase for the presence of characteristic flicker frequencies. Said two time phases do not overlap each other. They repeat periodically, e.g. in alternation. A plurality of first phases or a plurality of second phases can also follow in succession. This is the case, for instance, when a sharp rise in the scattered-light signal has been detected or when a flicker frequency has been detected.

In each first phase, the light transmitter is driven repeatedly, e.g. periodically, by a pulsed signal sequence to emit corresponding light pulses. The period of the pulsed signal sequence may lie in the range of 1 to 10 seconds. In other words, a pulsed signal sequence is emitted every 1 to 10 seconds. The pulsed signal sequence may include a rectangular clock signal, which drives the light transmitter, for instance via a switch, at the same rate, so that a sequence of periodic light pulses is produced in the light transmitter. Furthermore, one such pulsed signal sequence comprises a number of pulses, e.g. in the range of 32 to 1000 pulses. The length of one such signal sequence itself may lie in the range of 0.25 to 2 milliseconds. Thus the ratio of the signal sequence period to the time length of a signal sequence itself lies in the range of two to three orders of magnitude greater. The length of a single pulse itself typically lies in the range of 0.25 to 2 microseconds.

In some embodiments, the signal-based delimiting of the light receiver using a first filter, tuned to the same clock signal frequency of the pulsed signal sequence, is an effective means of suppressing light signals at other frequencies. In other words, in terms of signals, the detection takes account of only pulsed light scattered from detected particles such as smoke particles. This is performed in practice by a bandpass filter or high-pass filter that suppresses at least the frequency components in the photodiode signal and/or scattered-light signal below the clock signal frequency. The filter frequency of the high-pass filter or the bottom filter frequency of the bandpass filter lies in the range of 250 kHz to 2 MHz assuming that the pulse length of a single pulse lies in the range of 0.25 to 2 microseconds and that the clock signal and/or light signal is rectangular. The photodiode signal and/or scattered-light signal filtered in this manner is then fed to an A/D converter, which converts this signal into corresponding digital values for further fire analysis.

In each second phase, the light transmitter is dark. Thus the second phase can also be called a dark phase, in which the light transmitter does not emit any light. In this phase, a second filter is used for signal-based delimiting of the frequency components in the photodiode signal from the light receiver, said second filter being a low-pass filter. The cutoff frequency of the low-pass filter is designed such that the flicker frequencies in the range of 2 to 20 Hz for detection in each second phase can pass through the low-pass filter. The cutoff frequency, i.e. the filter frequency of the low-pass filter, may be set to a frequency in the range of 20 Hz to 40 Hz, but at least to a frequency of at least 20 Hz. With a setting to a value of 40 Hz, for instance, optical light signals from e.g. fluorescent tubes or computer monitors are suppressed effectively. The photodiode signal filtered in this manner is then fed to a further A/D converter, which converts this signal into corresponding digital values for further flicker frequency analysis.

In some embodiments, the control unit is configured to determine a first DC component from the received scattered-light signal/photo-signal, and is also configured to subtract this first DC component from the received scattered-light signal/photo-signal in order to obtain a scattered-light signal/photo-signal that contains substantially no DC component. The remaining higher-frequency component in the scattered-light signal/photo-signal is thereby shifted into the working range of the signal processing system in the sense of an offset. This prevents a potential overdrive of the signal processing system. The signal processing system may comprise, for instance, a transimpedance amplifier, bandpass or low-pass filter or an A/D converter. In the simplest case, the scattered-light signal/photo-signal is fed to a low-pass filter having a cutoff frequency that lies in a range of 1 to 2000 Hz, preferably in the range of 20 to 150 Hz.

In some embodiments, the control unit is configured to compare the determined first DC component with a specified overdrive value, and to output a fault signal if the determined first DC component exceeds the overdrive value for a specified minimum time. In this case, the photodiode is exposed to such a high level of brightness that it overdrives.

Reliable optical smoke detection is no longer possible under these circumstances. Outputting a fault signal can then alert a user to remedial action.

The overdrive value can be related, for example, to the level of illuminance for the photodiode, to which the photodiode or the common photodiode is exposed. The specified overdrive value may be greater than 100,000 lux. In this context, the value of 100,000 lux corresponds to a bright sunny day, with the fire detector or photodiode then being exposed to direct sunlight of such a bright sunny day. The specified minimum time for the output of the fault signal preferably lies in the range of 10 second to 10 minutes.

In some embodiments, the control unit is configured to monitor whether the scattered-light signal/photo-signal output by the (common) photodiode falls below a minimum brightness level, and on the basis thereof, to lower an alerting threshold for the output of a potential fire alarm. To do this, the control unit is configured to determine from the received scattered-light signal/photo-signal a second DC component. This represents the long-term average of a brightness value. It is also configured to monitor whether this second DC component falls below the minimum brightness level, and on the basis thereof, to lower the alerting threshold for the output of a potential fire alarm.

As a result of the more sensitive setting for the fire detector, an alarm can then be given more quickly during darkness, for instance at nighttime. This is because when the brightness level is lower, for instance at lux values of less than 1 lux, fewer disturbances from the detector surroundings can be expected than during the day. Examples of such optical disturbances are the flickering of fluorescent tubes or sunlight incident on the fire detector.

In some embodiments, the fire detector is a (sole) light-scattering smoke detector that comprises as a fire sensor an optical measuring chamber that is arranged in a detector housing, is shielded from ambient light and is permeable to smoke to be detected. The control unit is configured to analyze a scattered-light signal received from the optical measuring chamber, which signal forms the sensor signal, for an inadmissibly high signal level as a fire parameter and/or for an inadmissibly high rate of rise of the sensor signal as another fire parameter, and to output a fire alarm in the event of a fire being detected.

In some embodiments, the fire detector comprises at least one temperature sensor, in particular a thermistor, for sensing an ambient temperature in the region immediately around the fire detector. The control unit is configured to include the sensed ambient temperature in the fire analysis. Such a thermistor is what is known as an NTC or PTC, for example. The temperature sensor may also be a non-contact temperature sensor comprising a thermopile or a microbolometer. Taking into account the ambient temperature allows a fire to be detected even more reliably in the sense of a multi-criteria fire detector. This is the case, for instance, for a smoke-free fire such as an alcohol fire. A fire is detected in this case only by the sharp increase in the ambient temperature, whereas the scattered-light level increases only slightly.

In some embodiments, the fire detector is a (sole) thermal detector comprising a temperature sensor as the fire sensor. The control unit is configured to analyze a temperature signal received from the temperature sensor as the sensor signal for an inadmissibly high ambient temperature as a fire parameter and/or for an inadmissibly high temperature rise as another fire parameter, and to output a fire alarm in the event of a fire being detected. As described in the introduction, such a temperature sensor may be a temperature-dependent resistor (thermistor) such as an NTC or PTC, for instance.

In some embodiments, the temperature sensor is a non-contact temperature sensor, which comprises a thermal radiation sensor sensitive to thermal radiation in the infrared region. Examples of the latter are a thermopile or a microbolometer. In particular, the thermal radiation sensor is not an imager. In other words, it comprises a single pixel. In addition, the fire detector comprises a detector housing having a detector cover, wherein then the thermal radiation sensor is arranged in the detector housing, and for the purpose of deriving by calculation the ambient temperature, is oriented optically towards the internal face of the detector cover. The detector cover is designed in the region of the internal face for thermal conduction with an opposite region of the external face of the detector cover such that the housing temperature that arises on the internal face tracks the ambient temperature on the opposite region of the detector cover, in particular within a few seconds, for instance 5 seconds. By virtue of the temperature sensor integrated in the detector cover, the fire detector is less prone to soiling. In addition, the thermistor does not have to be installed in the housing, which involves complicated circuitry and assembly.

In some embodiments including a the closed light-scattering smoke detector and/or a thermal detector, the control unit is configured to monitor whether the photo-signal output by the photodiode falls below a minimum brightness level, and is configured to lower an alerting threshold for the output of a potential fire alarm in order to output a potential fire alarm more quickly. As a result of the more sensitive setting for the fire detector, an alarm can be given more quickly during darkness, for instance at nighttime. This is possible because when the brightness level is lower, for instance at lux values of less than 1 lux, fewer disturbances from the detector surroundings can be expected than during the day. Examples of such disturbances are the lighting of candles, smoke propagating during cooking and frying, or lighting a fireplace fire.

In some embodiments, the fire detectors comprise a wired or wireless connection to a higher-level control center. The control unit is configured to output to the control center whether the brightness is above or below the minimum brightness level as a day/night identifier. This can cause, for instance, blinds to be lowered or the heat output in the building to be lowered, under higher-level control by the control center.

FIG. 1 shows a spectral characteristic curve of a silicon PIN photodiode with and without daylight filter arranged in front. The maximum spectral sensitivity $S_{Rel}$, normalized to 100%, lies at a light wavelength $\lambda$ of approximately 900 nm, so in the near-infrared region. The continuous curve shows the spectral sensitivity $S_{Rel}$ of a silicon PIN photodiode with a daylight filter arranged in front. In this case, light of wavelength $\lambda$ of less than 730 nm is suppressed. The dashed branch of the curve shows in contrast the spectral sensitivity $S_{Rel}$ of the silicon PIN photodiode without daylight filter.

Figure 2:
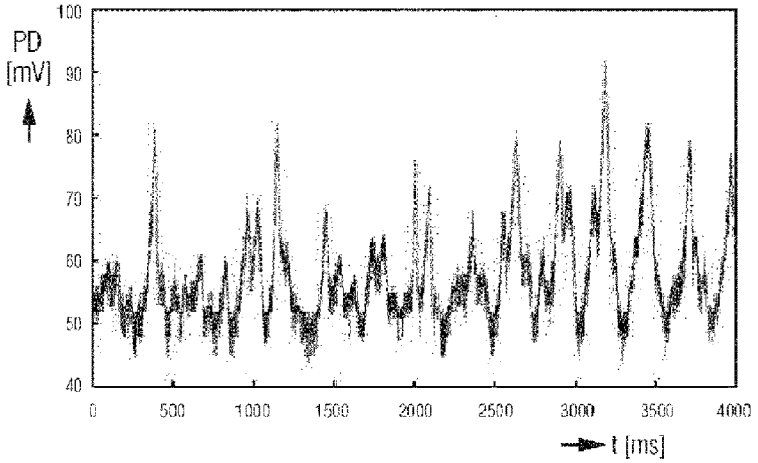
FIG. 2 shows an example of a photo-signal received from a photodiode and containing characteristic flicker frequencies for an open fire.

FIG. 2 shows an example of a photo-signal PD received from a photodiode 6 and containing characteristic flicker frequencies for open fire, measured in millivolts. The photovoltage produced at the photodiode 6 is measured here as the photo-signal PD. The measurement is carried out over a time period of 4 seconds and shows periodic voltage spikes in the range of 20 to 30 mV, which correlate with the flickering of the flames of open fire.

Figure 3:
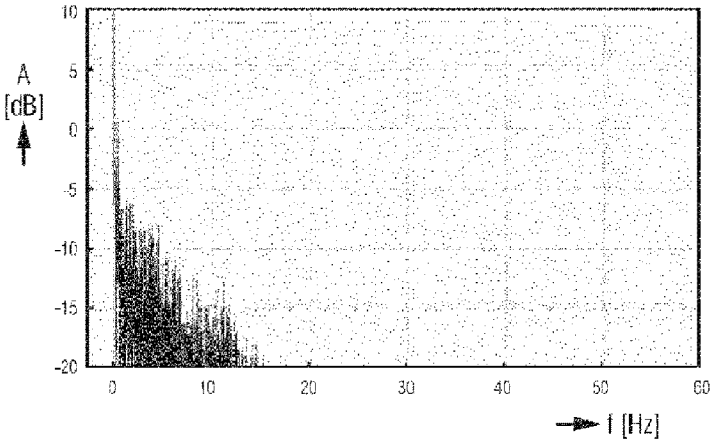
FIG. 3 shows the frequency spectrum associated with the photo-signal of FIG. 2.

FIG. 3 shows the frequency spectrum associated with the photo-signal PD shown in FIG. 2. The spectral amplitude, measured in dB, is denoted by A and plotted against frequency f in Hertz. Looking at just the frequency range relevant to flickering, which is the frequency range of at least 2 Hz, the amplitude can be seen to decrease reciprocally for frequencies increasing from 2 Hz. The spectrum shown is typical of, and signifies, open flickering fire.

Figure 4:
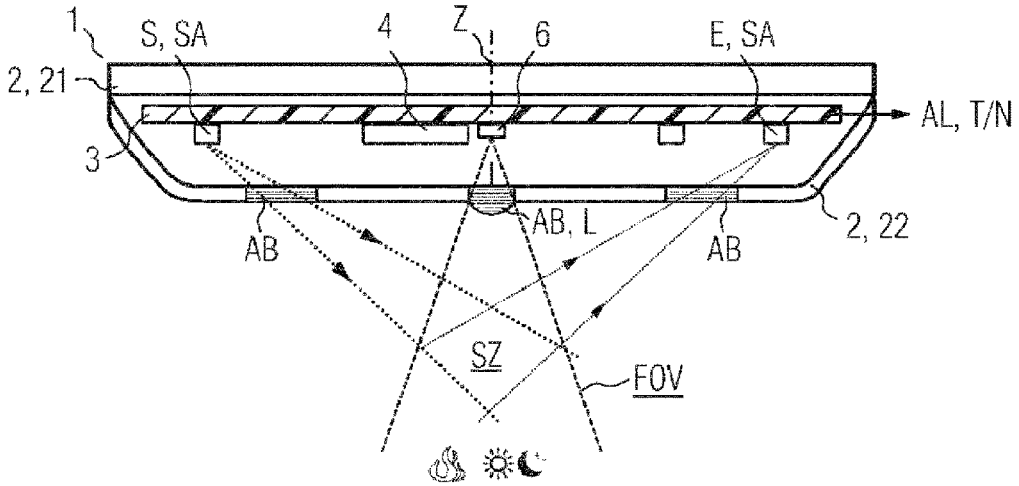
FIG. 4 shows by way of example an open light-scattering detector having a light-scattering center located outside the detector for smoke detection, and having a photodiode for sensing ambient light for detecting open fire incorporating teachings of the present disclosure.

FIG. 4 shows an open light-scattering detector 1 having a light-scattering center SZ located outside the detector 1 for smoke detection, and having a photodiode 6 for sensing ambient light for detecting open fire according to the invention. In the present example, the detector 1 comprises a housing 2 composed of a base element 21 and a detector cover 22.

The detector 1 can be attached by the base element 21 to a detector base mounted on a ceiling. Both housing parts 21, 22 are typically made from a light-tight plastics housing. A circuit mount 3 is accommodated in or on the housing 2, on which circuit mount are applied a light transmitter S in the form of a light emitting diode, a light receiver E in the form of a photosensor and a microcontroller 4 as the control unit. The photosensor E is preferably a photodiode. Light transmitter S and light receiver E are thus arranged in the housing 2. At the same time, they are also arranged in a light-scattering arrangement SA having a light-scattering center SZ located outside the light-scattering smoke detector 1 in the open. The light-scattering arrangement SA here forms the actual fire sensor with the light transmitter S and the light receiver E.

There are two apertures in the detector cover 22 for detecting smoke in the open. A light beam emitted by the light transmitter S reaches outside through the first aperture. In the opposite direction, the scattered light from the smoke particles to be detected reach the light receiver E in the housing 2 through the second aperture. In the present example, the two apertures, which are not described further, are closed by a transparent cap, for instance made of plastics material.

The control unit 4 shown is configured to analyze a scattered-light signal received from the fire sensor for an inadmissibly high signal level as a fire parameter. In some embodiments, can be configured to analyze the scattered-light signal for an inadmissibly high rate of rise as another fire parameter. In the event of a fire being detected, a fire alarm AL can be output by the control unit 4.

The light-scattering smoke detector 1 comprises a photodiode 6 for sensing ambient light. In the present example, the photodiode 6 is arranged on the circuit mount 3 and oriented such that it "looks" outside through an additional aperture in the detector cover 22. The additional aperture may be located at a central point of the detector cover 22 to facilitate a symmetrical all-round view for sensing ambient light. The central main axis of the detector 1 is denoted by Z here. Such detectors 1 typically have a rotationally symmetric design. FOV denotes here the optical detection region of the photodiode 6. In addition, the additional aperture is closed by an additional transparent cap AB to prevent the ingress of dirt into the housing interior. The caps AB can already be equipped with a daylight filter, or comprise same. In the example of the present FIG. 4, the central cap AB is also embodied as an optical lens L. This allows an extended all-round optical view.

In some embodiments, the control unit 4 is configured to analyze a photo-signal received from the photodiode 6 for the presence of flicker frequencies characteristic of open fire, and on the basis thereof, to output a potential fire alarm more quickly. It is also configured to monitor the photo-signal for being above or below a minimum brightness level and to output same as a day/night identifier T/N, symbolized by a sun and moon icon, for instance to a higher-level control center.

Figure 5:
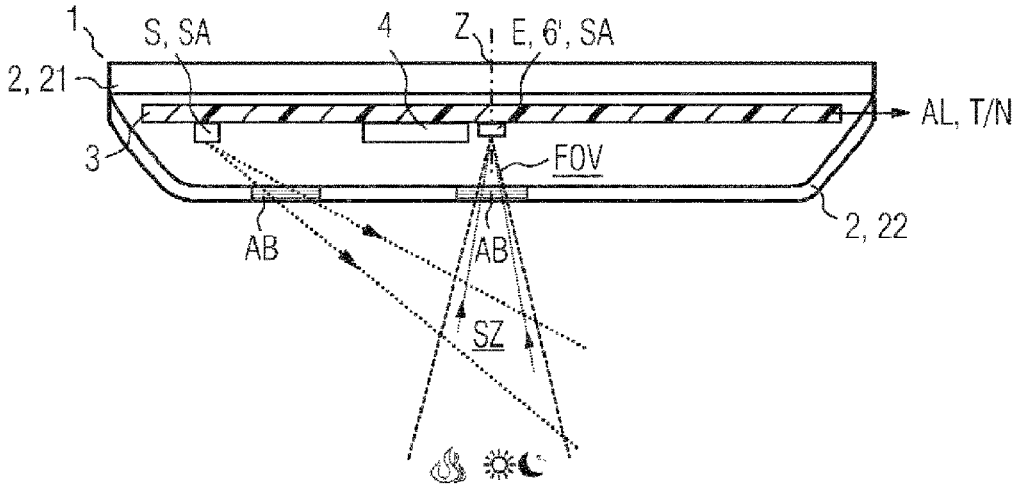
FIG. 5 shows a first embodiment of the fire detector incorporating teachings of the present disclosure having a common photodiode for smoke detection and for the ambient light.

FIG. 5 shows a first embodiment of the fire detector 1 incorporating teachings of the present disclosure having a common photodiode 6'. It is configured both for smoke detection and for sensing ambient light.

Figure 6:
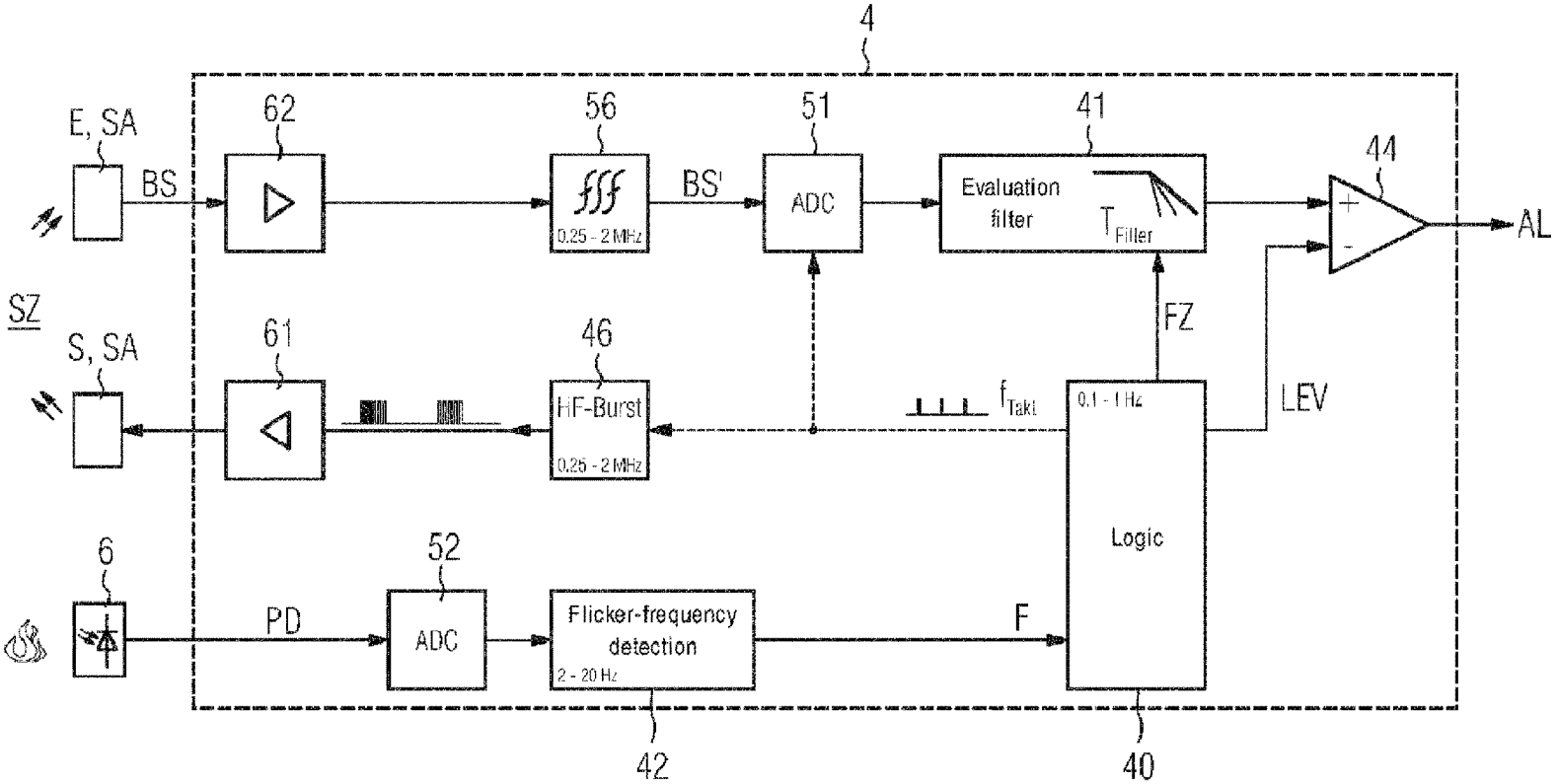
FIG. 6 shows a functional block diagram of a detector control unit comprising an evaluation filter having an adjustable time constant for outputting a potential fire alarm more quickly incorporating teachings of the present disclosure.

FIG. 6 shows a functional block diagram of a detector control unit 4 comprising an evaluation filter 41 having an adjustable time constant $T_{Filter}$ for outputting a potential fire alarm more quickly according to the invention. The function blocks 40-44 shown may be implemented as software, e.g. as program routines, which are executed by a processor-based control unit, for instance by a microcontroller. The program routines are loaded in a memory of the microcontroller 4. The memory may comprise a non-volatile electronic memory such as a flash memory, for instance. The microcontroller 4 may additionally comprise specific function blocks that are already integrated as hardware function units in the microcontroller 4, for instance units such as analog-to-digital converters 51, 52, signal processors, digital input/output units and bus interfaces.

In the example, the microcontroller 4 comprises two analog-to-digital converters 51, 52. The first A/D converter 51 is provided for digitizing a filtered scattered-light signal BS' originating directly from the light receiver E of the light-scattering arrangement SA. The second A/D converter 52 is provided for digitizing a photo-signal PD output by the photodiode 6.

For the purpose of performing open light-scattering smoke detection, a frequency generator 46 drives the light transmitter S, i.e. the light emitting diode, periodically with a pulsed signal sequence in the range of 0.25 to 2 MHz. The light emitting diode S itself thus emits corresponding light pulses into the light-scattering center SZ. The frequency generator 46 is driven on its input side via a logic block 40 of the control unit 4 via a clock signal $f_{Takt}$, with the frequency generator 46 outputting per clock pulse a pulsed signal sequence comprising a specified number of pulses, for instance in the range of 32 to 1000 pulses. The clock signal $f_{Takt}$ output by the logic block 40 has a frequency in the range of 0.1 to 1 Hz.

Connected after the photodiode E, provided for scattered-light detection, is a transimpedance amplifier 62, which converts the photo-current produced by the photodiode E into a suitable measurement voltage for further signal processing. This amplified scattered-light signal BS is finally fed to a bandpass filter 56, which is implemented as a digital filter. This bandpass filter 56 passes only high-frequency signal components in the unfiltered scattered-light signal BS, which approximately correspond to the high-frequency pulsed signal sequence. This is an effective means of suppressing lower-frequency parasitic optical signals.

The clock signal $f_{Takt}$ is likewise fed also to the first A/D converter 51, which then converts the currently present filtered scattered-light signal BS' into a digital value. The digitized scattered-light signal BS' is then fed along the optical path to a (digital) evaluation filter 41. The evaluation filter 41 may comprise a digital low-pass filter which performs a certain degree of signal-smoothing or averaging. This filtering, however, results in a delayed filter response at the output of the evaluation filter 41 similar to a filter time constant for a low-pass filter. The output signal (not described further) from the evaluation filter 41 is then fed to a comparator 44, which compares this signal with an alerting threshold LEV, which corresponds to a minimum smoke concentration level for giving the fire alarm. If the filter output signal exceeds this comparative value LEV, then a fire alarm AL is output, for instance to a higher-level central fire-alarm system.

In some embodiments, the microcontroller 4 is also configured to analyze the photo-signal PD received from the photodiode 6 for the presence of flicker frequencies characteristic of open fire, and on the basis thereof, to output a potential fire alarm more quickly. The spectral signal analysis can be performed, for example, by a digital Fourier transform or by wavelet analysis. This is achieved technically by the flicker-frequency detector function block 42.

In the event of flickering fire being detected, this function block outputs a flicker indicator F to a logic block 40, which thereupon increases the sampling rate or the clock frequency of the clock signal $f_{Takt}$ of the A/D converter 51 for digitizing the filtered scattered-light signal BS' and/or reduces the filter time constant $T_{Filter}$ of the evaluation filter 41. The flicker indicator F may be, for example, a binary value, for instance 0 or 1, or a digital value, for instance in the range of 0 to 9. The value 0, for the binary case, can represent, for instance, that flicker frequencies are not present, and the value 1 correspondingly that they are present. In the digital case, the value 0 can represent, for instance, that flicker frequencies are not present. The values 1 to 9 can indicate, for example, that flicker frequencies are present, with high numerical values indicating high flicker-frequency levels and low numerical values indicating low flicker-frequency levels. By increasing the sampling rate, the digitized filtered scattered-light signal BS' is available more quickly at the evaluation filter 41 for further processing. In some embodiments, by reducing the filter time constant $T_{Filter}$, the evaluation filter 41 responds more quickly, and therefore an actual rise in the filtered scattered-light signal BS' also results in giving a fire alarm AL more quickly. Increasing the sampling rate and/or reducing the filter time constant $T_{Filter}$ can, for instance for the digital case of the flicker indicator F, be performed according to the value range of the indicator.

In some embodiments, the logic block 40 can be programmed such that the alerting threshold LEV is lowered, for instance 10%, 20%, 30% or 50%, according to the flicker indicator F. For the fire situation that is more likely to be occurring on the basis of the detected flicker frequency, this results in a fire alarm being output more quickly.

Figure 7:
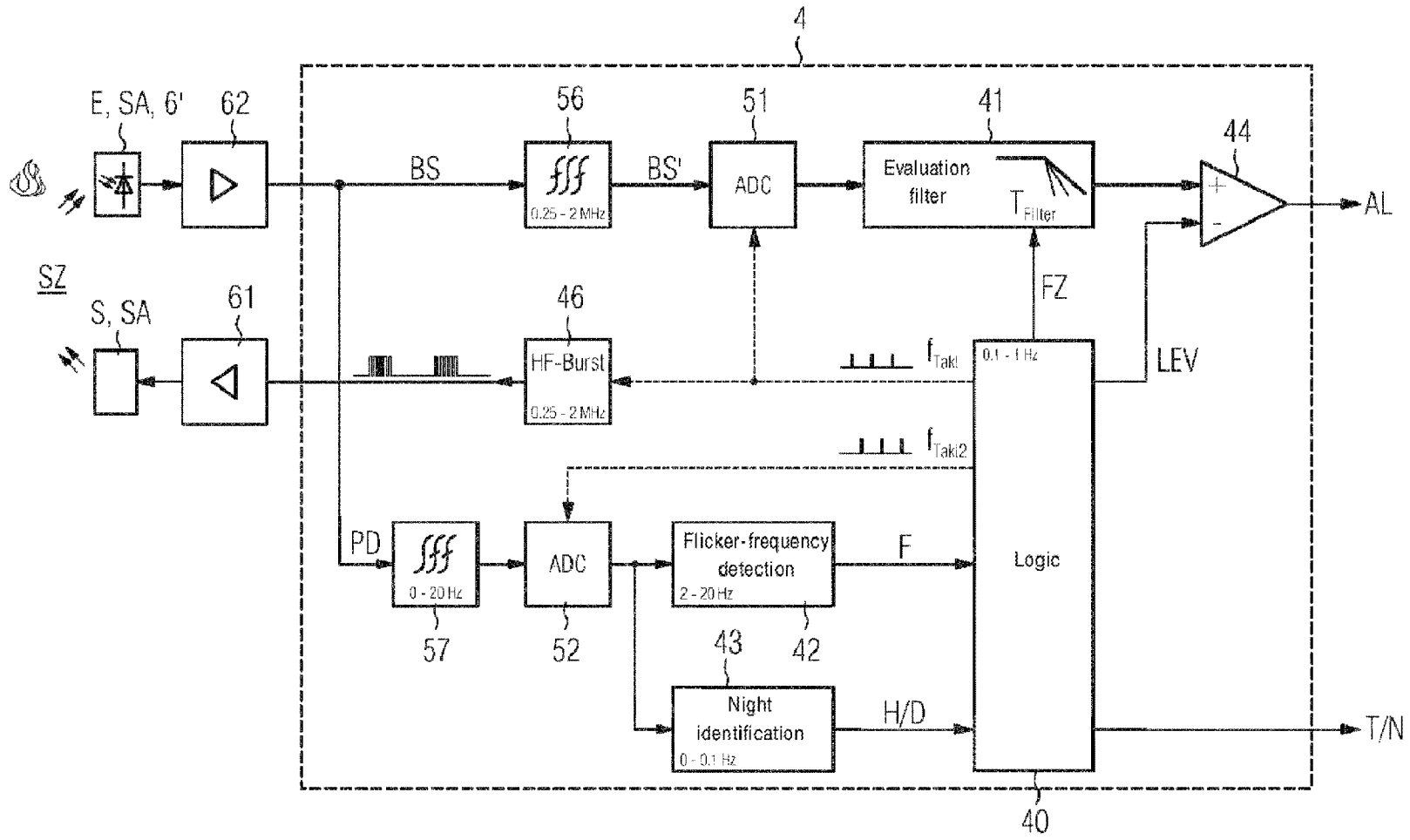
FIG. 7 shows a second functional block diagram of a detector control unit comprising input-side acquisition and evaluation of a scattered-light signal/photo-signal from a common photodiode and comprising night-identification incorporating teachings of the present disclosure.

FIG. 7 shows a second functional block diagram of a detector control unit 4 comprising input-side acquisition and evaluation of a scattered-light signal/photo-signal BS from a common photodiode 6' and comprising night-identification incorporating teachings of the present disclosure. The control unit 4 is configured in this case to analyze in time-separated phases the scattered-light signal/photo-signal BS, PD received from the common photodiode 6'. In a particular first phase associated with the clock signal $f_{Takt}$, the control unit 4 analyzes whether the signal level of the filtered scattered-light signal/photo-signal BS' is inadmissibly high. In some embodiments, it analyzes whether this signal level is rising inadmissibly quickly. Moreover, the control unit 4 may be configured to analyze the received scattered-light signal/photo-signal BS, PD in a particular second phase associated with the second clock signal $f_{Takt2}$ for the presence of characteristic flicker frequencies. The received scattered-light signal/photo-signal BS, PD first passes through a low-pass filter 57 in order to suppress in particular the high-frequency signal components originating directly from the clock generator 46. The signal at the output of the low-pass filter 57 is fed to an A/D converter 52, which converts this signal into corresponding digital values for the subsequent flicker-frequency detector 42.

The latter performs, as already described in the example of FIG. 6, a spectral signal analysis with regard to the occurrence of flicker frequencies characteristic of open fire. Driving the two A/D converters 51, 52 at a phase-offset is necessary only as part of the fire analysis. Depending on the microcontroller used as the control unit 4, both A/D converters 51, 52 can also be driven simultaneously, which can be advantageous for power consumption according to the particular design.

Compared with the previous embodiment shown in FIG. 6, the control unit 4 additionally comprises a night-identification function block 43 in order to lower an alerting threshold LEV for the output of a potential fire alarm AL on the basis of the ascertained brightness in the surroundings of the fire detector. In the example of the present FIG. 7, the control unit 4 determines a second DC component H/D from the received scattered-light signal/photo-signal BS, PD, which component represents the long-term average of a brightness value. It monitors whether this second DC component H/D falls below a minimum brightness level, and then on the basis thereof, lowers the alerting threshold LEV for the output of a potential fire alarm AL.

In some embodiments, the night-identification block 43 comprises for determining the second DC component H/D a digital low-pass filter having a cutoff frequency in the range of 0 to 0.1. The scattered-light signal/photo-signal, which has already been pre-filtered by the low-pass filter 57 and digitized by the A/D converter 52, is input to the night-identification block 43. The second DC component H/D can represent a binary brightness value for light and dark. In some embodiments, it represents a digital value, for instance a lux value, having a graduated value range.

In some embodiments, the logic block 40 is programmed such that the alerting threshold LEV is lowered in particular when the second DC component H/D falls below a minimum brightness level, for instance below a value of 1 lux. This example value corresponds to a dark to heavy dusk environment. Fewer optical disturbances from the detector surroundings can be expected in such an environment than during the day. The assumption of fewer disturbances from the detector surroundings allows the alerting threshold LEV to be lowered. The more sensitive setting results in a fire alarm being output more quickly because the output signal from the evaluation filter 41 now exceeds the lowered alerting threshold LEV more quickly.

Figure 8:
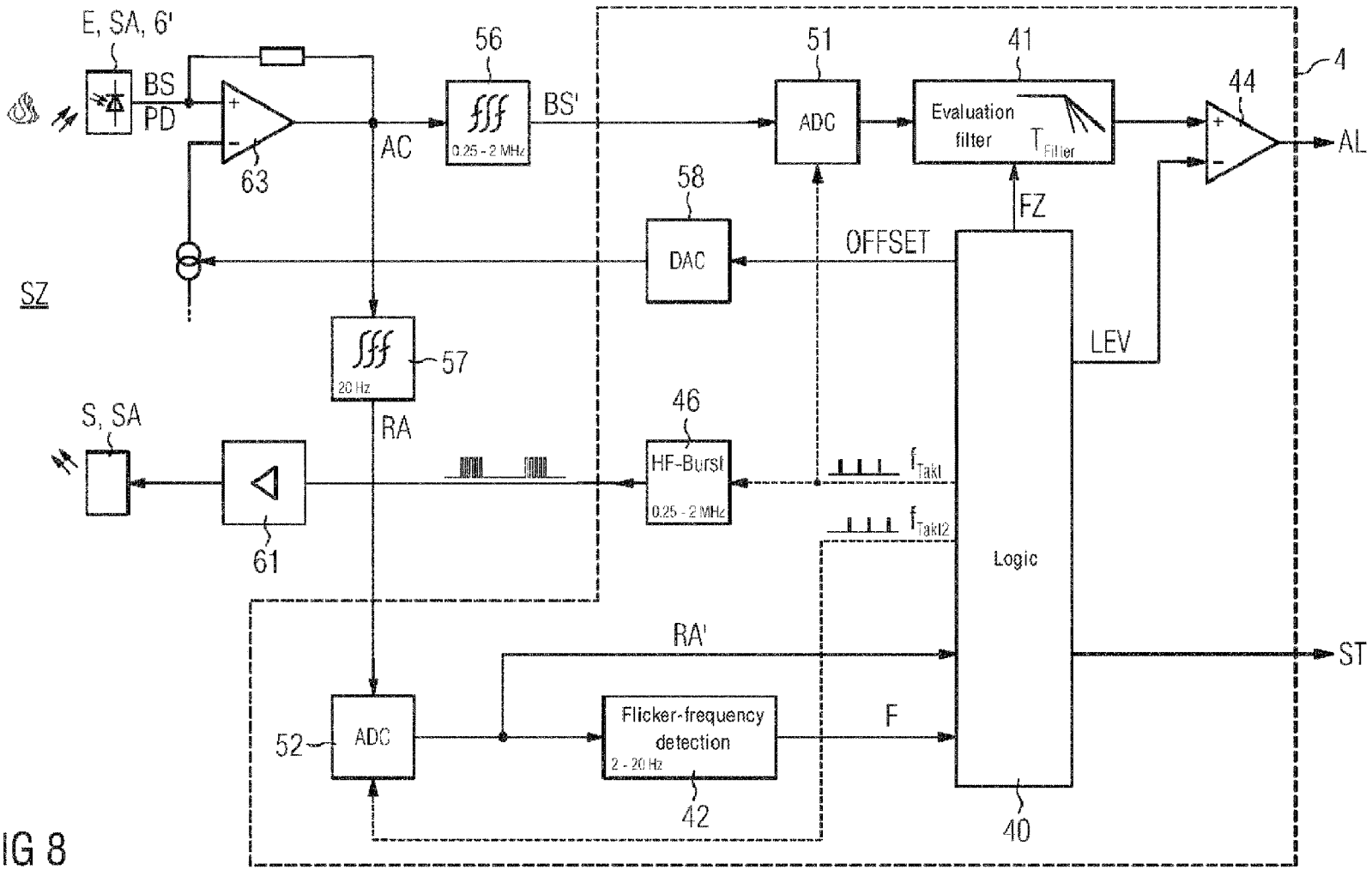
FIG. 8 shows a third functional block diagram of a control unit as an exemplary embodiment of the offset compensation incorporating teachings of the present disclosure of the photodiode.

FIG. 8 shows a third functional block diagram of a control unit 4 as an exemplary embodiment of the offset compensation incorporating teachings of the present disclosure. for the photodiode 6'. For the purpose of offset compensation, i.e. for compensating the DC component of the scattered-light signal/photo-signal BS, PD, this is fed, for example, to a non-inverting input of an operational amplifier 63. The output of the operational amplifier 63 is likewise fed back to the non-inverting input via a feedback resistor, which is not described further. The present circuit arrangement thus shows schematically a transimpedance converter known per se, which converts the photo-current produced by the photodiode 6' into a photo-voltage proportional thereto at the output of the operational amplifier 63. The offset compensation prevents the transimpedance amplifier being overdriven.

The circuit arrangement in FIG. 8 shows in detail a control loop for the offset compensation incorporating teachings of the present disclosure. Said control loop comprises the operational amplifier 63 as a comparator, a low-pass filter 57 connected thereafter and having a cutoff frequency of 20 Hz here by way of example, a subsequent A/D converter 52, a controller implemented by the logic block 40, which is connected on the input side to the output of the A/D converter 52, a digital-to-analog converter 58 after the controller, and a voltage-controlled current source (not described further) after the D/A converter 58. Said current source acts as the control-loop feedback to the inverting input of the transimpedance converter or operational amplifier 63.

In the controlled state, a scattered-light signal/photo-signal AC that contains substantially no DC component is present at the output of the operational amplifier 63. This signal AC is fed to a bandpass filter 56, which is tuned to the carrier frequency or clock frequency of the frequency generator 46. The scattered-light signal/photo-signal BS' filtered in this way is then output, as already described previously, to an A/D converter 51, which feeds the corresponding digitized values to an evaluation filter 41, which is connected on its output side, for fire analysis.

In some embodiments, the scattered-light signal/photo-signal AC that contains substantially no DC component is also fed to a low-pass filter 57 having a cutoff frequency of 20 Hz for example. The signal present at the filter output here forms the control error RA of the control loop. This is fed to the A/D converter 52, which converts the signal of the control error RA into corresponding digital values of the control error RA'. A subsequent controller, implemented in the logic block 40 in software, determines according to the height of the control error RA' a first DC component OFFSET for the offset compensation of the received scattered-light signal/photo-signal BS, PD. A subsequent D/A converter 58 converts this first DC component OFFSET into a DC voltage, which is used to drive a subsequent voltage-controlled current source. The latter achieves, via the inverting input of the operational amplifier 63, subtraction of this first DC component OFFSET from the received scattered-light signal/photo-signal BS, PD in order to produce finally the scattered-light signal/photo-signal AC that contains substantially no DC component. The control loop is now closed.

In some embodiments, the output signal from the A/D converter 52, as already described, is again fed to a flicker frequency block 42 for detecting flicker frequencies characteristic of open fire. In the present example, the logic block 40 is also configured or programmed to compare the determined first DC component OFFSET with a specified overdrive value, and to output a fault signal ST if the determined first DC component OFFSET exceeds the overdrive value for a specified minimum time.

Figure 9:
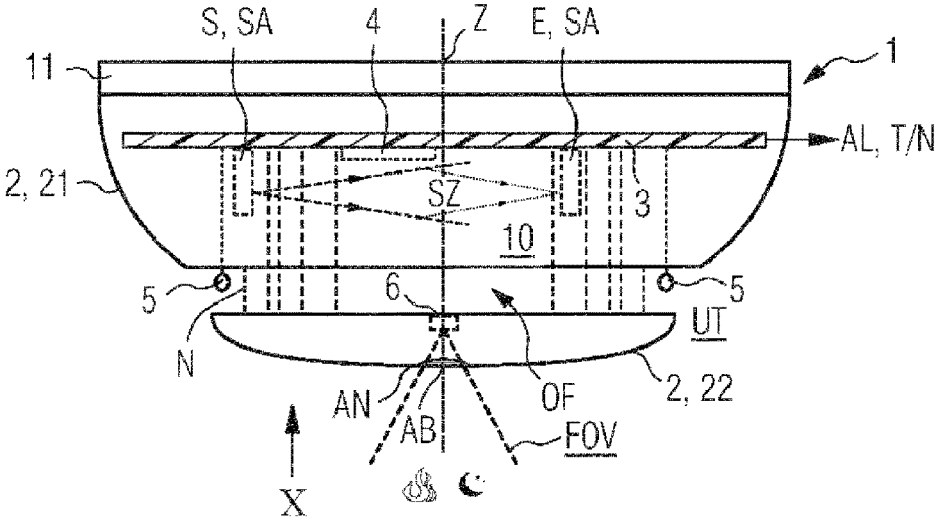
FIG. 9 shows in a sectional view an example of a light-scattering smoke detector of closed design as a fire detector having an optical measuring chamber and having a photodiode for ambient light for detecting open fire incorporating teachings of the present disclosure.

FIG. 9 shows in a sectional view an example of a light-scattering smoke detector 1 of closed design as a fire detector having an optical measuring chamber 10 and having a photodiode 6 for ambient light for detecting open fire incorporating teachings of the present disclosure. In the present example, the detector 1 comprises a housing 2 composed of a base element 21 and a detector cover 22. The detector 1 can then be attached by the base element 21 to a detector base 11 mounted on a ceiling. Both housing parts 21, 22 are typically made from a light-tight plastics housing. A circuit mount 3 may be accommodated inside the detector 1. Arranged thereon, in addition to a microcontroller 4 as a control unit, are also a transmitter S, typically an LED, and a receiver E, e.g. a photodiode, as parts of a light-scattering arrangement SA. SZ denotes the light-scattering center SZ or measurement volume, which is formed by the light-scattering arrangement SA, for optical smoke detection. The light-scattering arrangement SA is here enclosed by a labyrinth and forms therewith the optical measuring chamber 10. The latter thus forms a fire sensor 10. In addition, OF denotes a, for example circumferential, smoke entry aperture, and N denotes an insect shield. Two oppositely located thermistors 5 for sensing the ambient temperature as an additional fire parameter are present in the region of the smoke entry aperture OF.

Inside the detector cover 22 is arranged a photodiode 6, which lies opposite an opening AN on the external face of the detector cover 22. The photodiode 6 can "see" though this opening AN into the region surrounding the detector 1. FOV denotes the associated optical detection region of the photodiode 6. The photodiode 6 can then optically detect open fire in this detection region FOV, symbolized by a flame icon. In the present example, the opening AN in the detector cover 22 is equipped with a transparent cap AB to protect against dirt. The cap AB may comprise a light-transmissive plastics material. It may include a daylight filter. In the case of a fire being detected, a fire alarm AL can be output to a higher-level central fire-alarm system. In addition, a day/night identifier T/N can be output. Z denotes the geometric central main axis of the detector 1.

Figure 10:
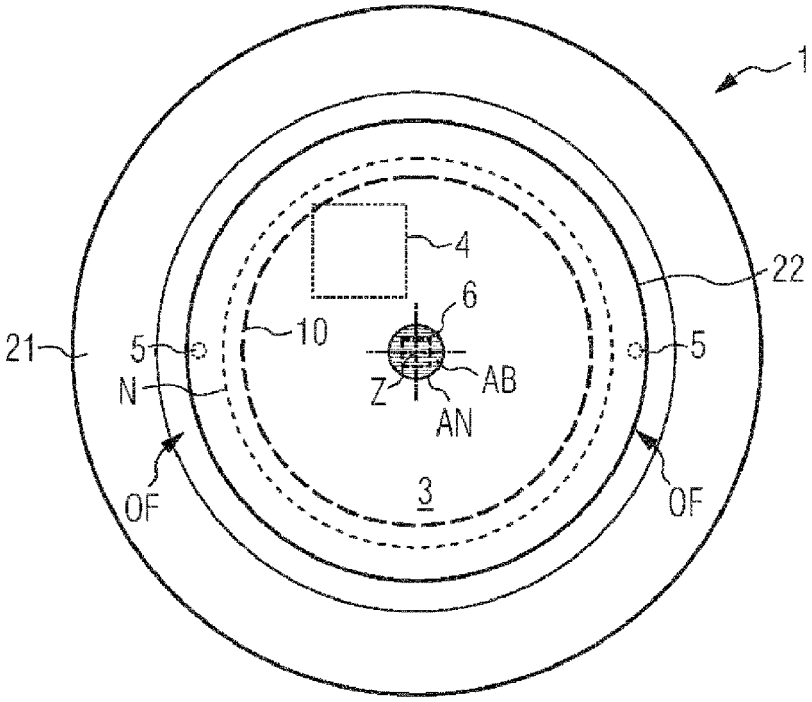
FIG. 10 shows the example of FIG. 9 in a plan view along the viewing direction IX.

FIG. 10 shows the example of FIG. 9 in a plan view along the indicated viewing direction X. In some embodiments, the control unit 4 is configured to analyze a photo-signal received from the photodiode 6 for the presence of flicker frequencies characteristic of open fire, and on the basis thereof, to output a potential fire alarm more quickly. In addition, it is also already configured to monitor the photo-signal for being above or below a minimum brightness level and to output same as a day/night identifier T/N, symbolized by a sun and moon icon. The latter can be output to a higher-level control center, for instance in order to open or close blinds or to switch light on and off.

Figure 11:
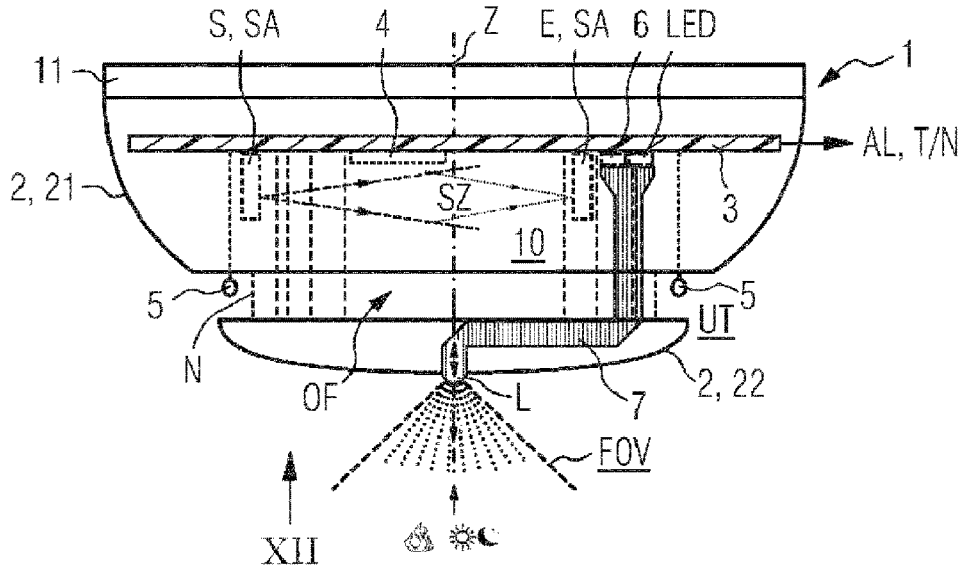
FIG. 11 shows an embodiment of the fire detector incorporating teachings of the present disclosure having a common light guide for sensing ambient light by means of the photodiode and as an indicator in the sense of an operational indicator.

FIG. 11 shows an embodiment of the fire detector 1 having a common light guide 7 for sensing ambient light by means of the photodiode 6 and as an indicator in the sense of an operational indicator.

The photodiode 6 shown may comprise a silicon photodiode and in particular a silicon PIN photodiode. Unlike the previous embodiment, the photodiode 6 for the ambient light sensing is now arranged on the circuit mount 3. It may be applied adjacent to an indicator light emitting diode LED, which is likewise arranged on the circuit mount 3.

The light guide 7 is such that at a first end it faces both the indicator light emitting diode LED and the photodiode 6. The second end of the light guide 7 may extend through a central opening in the detector cover 22. The photodiode 6 can thereby detect ambient light through the light guide 7. Independently thereof, in the opposite direction, light from the indicator light emitting diode LED can be coupled through the light guide 7 and out at the second end of the light guide 7. The indicator light emitting diode LED is driven periodically, for instance every 30 seconds, to emit an optically visible pulse for the operational indicator of the fire detector 1. In particular, the second end of the light guide 7 is embodied as an optical lens L. This makes it possible to detect ambient light from a larger optical detection region FOV.

Furthermore, the operational indicator of the fire detector 1 is visible in a larger solid-angle range. The light guide 7 is preferably made in a single piece from a transparent plastics material.

Figure 12:
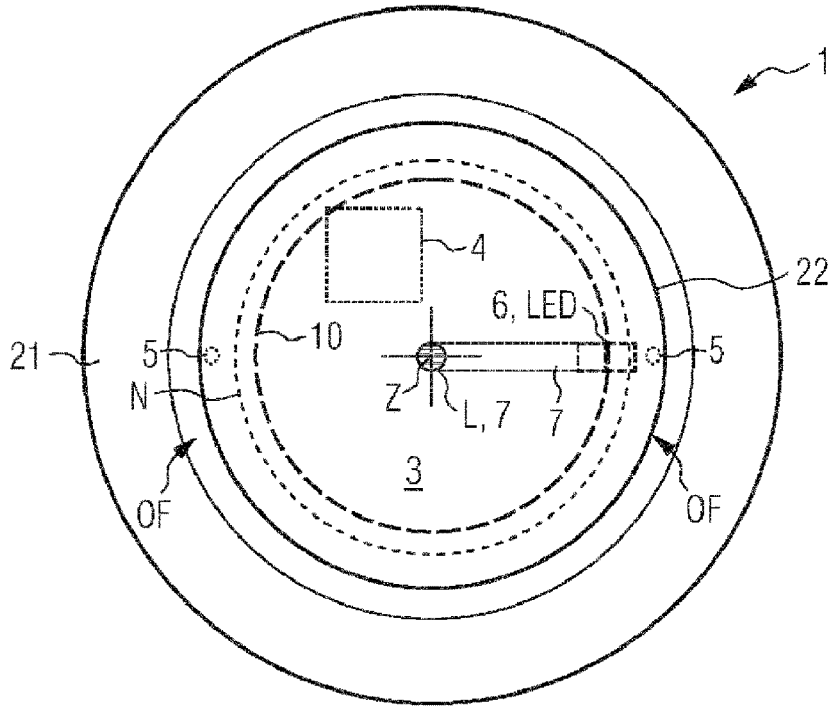
FIG. 12 shows the example of FIG. 11 in a plan view along the viewing direction XI.

FIG. 12 shows the example of FIG. 11 in a plan view along the viewing direction XII indicated in FIG. 11. The central arrangement of the second end of the light guide 7 is evident in particular in this view.

Figure 13:
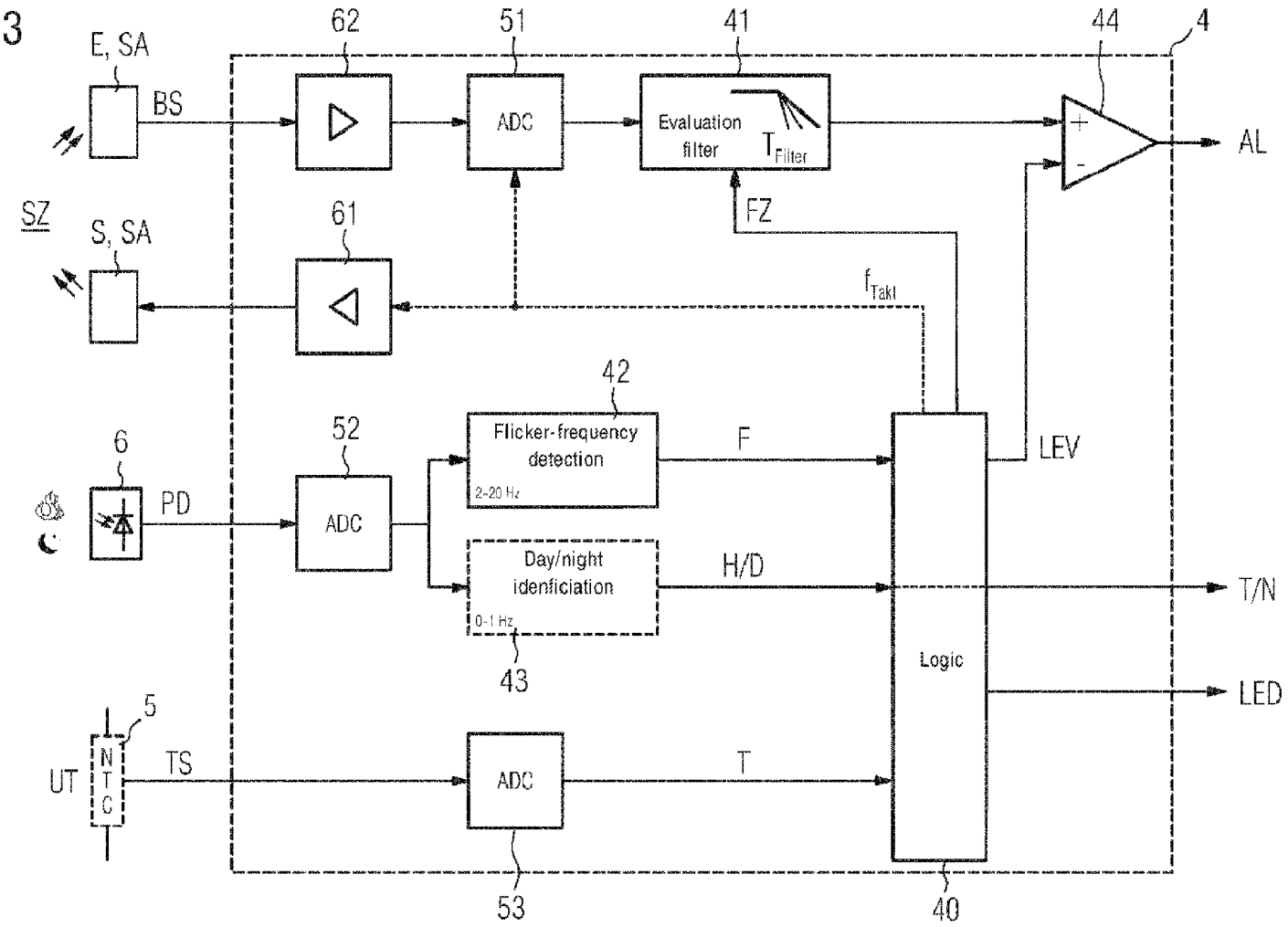
FIG. 13 shows a functional block diagram of a detector control unit comprising an evaluation filter having an adjustable time constant for outputting a potential fire alarm more quickly incorporating teachings of the present disclosure.

FIG. 13 shows a functional block diagram of a detector control unit 4 comprising an evaluation filter 41 having an adjustable time constant $T_{Filter}$ for outputting a potential fire alarm more quickly incorporating teachings of the present disclosure.

The function blocks 40-44 shown may be implemented as software, e.g. as program routines, which are executed by a processor-based control unit, for instance by a microcontroller. The program routines may be loaded in a memory of the microcontroller 4. The memory may comprise a non-volatile electronic memory such as a flash memory, for instance. The microcontroller 4 may additionally comprise specific function blocks that are already integrated as hardware function units in the microcontroller 4, for instance units such as analog-to-digital converters 51-53, signal processors, digital input/output units and bus interfaces.

In the top left portion of FIG. 13 can be seen a light-scattering arrangement SA as part of the optical measuring chamber or fire sensor. The light-scattering arrangement SA comprises a transmitter S and receiver E. Both are oriented towards a common light-scattering center SZ as the measurement volume and are spectrally tuned to one another. The transmitter S may comprise a light emitting diode. The receiver E may comprise a photosensor and/or a photodiode. The light emitting diode may emit monochromatic infrared light, e.g. in the range of 860 to 940 nm±40 nm, and/or monochromatic ultraviolet light, e.g. in the range 390 to 460 nm±40 nm. Scattered light originating from particles to be detected such as smoke particles in the light-scattering center SZ can then be detected by the receiver E. The scattered-light level or the amplitude of the scattered-light signal BS is here a measure of the concentration of the detected particles. The scattered-light signal BS may be first amplified by an amplifier 62, in particular by a transimpedance amplifier.

The logic block 40 of the control unit 4 emits a pulsed clock signal $f_{Takt}$ for driving the light emitting diode S repeatedly with pulses. This clock signal is amplified by another amplifier 61 and fed to the light emitting diode S. The clock signal $f_{Takt}$ is typically periodic. It preferably has a pulse width in the range of 50 to 500 μs and a clock frequency in the range of 0.1 to 2 Hz. For synchronous detection of the scattered light, this clock signal $f_{Takt}$ is fed to an associated analog-to-digital converter 51. In the present example, the microcontroller 4 comprises three analog-to-digital converters 51-53 by way of example. The first A/D converter 51 is used for digitizing the scattered-light signal BS from the fire sensor, i.e. in this case from the optical measuring chamber. The second A/D converter 52 is provided for digitizing a photo-signal PD, which is provided by a photodiode 6 for sensing ambient light in the (immediate) surroundings of the detector 1. The photo-signal PD may be first amplified by an amplifier 61, typically by a transimpedance amplifier. The third A/D converter 53 is provided for digitizing a temperature signal TS, which is output by an NTC as a temperature sensor 5 for sensing the ambient temperature UT in the (immediate) surroundings of the detector 1.

The digitized scattered-light signal is then fed along the optical path to a (digital) evaluation filter 41. The evaluation filter 41 may comprise a digital low-pass filter which performs a certain degree of signal-smoothing or averaging. This filtering, however, results in a delayed filter response at the output of the evaluation filter 41 similar to a filter time constant for a low-pass filter. The output signal (not described further) from the evaluation filter 41 is then fed to a comparator 44, which compares this signal with an alerting threshold LEV, for instance with a minimum smoke concentration level for giving the alarm. If the filter output signal exceeds this comparative value LEV, then a fire alarm AL is output, for instance to a higher-level central fire-alarm system.

In some embodiments, the microcontroller 4 is configured to analyze the photo-signal PD received from the photodiode 6 for the presence of flicker frequencies characteristic of open fire, and on the basis thereof, to output a potential fire alarm more quickly. The spectral signal analysis can be performed, for example, by a digital Fourier transform or by wavelet analysis. This is achieved technically by the flicker-frequency detector function block 42.

In the event of flickering fire being detected, this function block outputs a flicker indicator F to a logic block 40, which thereupon increases the sampling rate of the A/D converter 51 for digitizing the scattered-light signal BS and/or reduces the filter time constant $T_{Filter}$. The flicker indicator F may be, for example, a binary value, for instance 0 or 1, or a digital value, for instance in the range of 0 to 9. The value 0, for the binary case, can represent, for instance, that flicker frequencies are not present, and the value 1 correspondingly that they are present.

In the digital case, the value 0 can represent, for instance, that flicker frequencies are not present. The values 1 to 9 can indicate, for example, that flicker frequencies are present, with high numerical values indicating high flicker-frequency levels and low numerical values indicating low flicker-frequency levels. By increasing the clock frequency or sampling rate $f_{Takt}$, the digitized scattered-light signal BS is available more quickly at the evaluation filter 41 for further processing. In some embodiments, by reducing the filter time constant $T_{Filter}$, the evaluation filter 41 responds more quickly, and therefore an actual rise in the scattered-light signal BS also results in giving a fire alarm AL more quickly. Increasing the sampling rate $f_{Takt}$ and/or reducing the filter time constant $T_{Filter}$ can, for instance for the digital case of the flicker indicator F, be performed according to the value range of the indicator.

In some embodiments, the logic block 40 can also be programmed to lower the alerting threshold LEV if a light/dark indicator H/D, which is provided by the function block 43 of the microcontroller 4, falls below a minimum brightness level. Example values for said level are 0.1 lux, 1 lux or 5 lux. These example values correspond to a dark to heavy dusk environment. The value for the alerting threshold LEV can be lowered, for example, by 10%, 20, 30% or 50%.

As described above, fewer disturbances from the detector surroundings can be expected in such an environment than during the day, for instance by the increase in smoke particles caused by lighting candles, smoke propagating during cooking and frying, or lighting a fireplace fire and the like. The assumption of fewer disturbances from the detector surroundings therefore also allows the alerting threshold LEV to be lowered. The more sensitive setting results in a fire alarm being output more quickly because the output signal from the evaluation filter 41 exceeds the lowered alerting threshold LEV more quickly. The day/night identification is performed by low-pass filtering of the photo-signal PD with a time constant of less than 1 Hz, in particular of less than 0.1 Hz.

In the example of FIG. 13, the control unit 4 is connected to a thermistor 5 (NTC) for sensing the ambient temperature UT in the region immediately around the fire detector. The control unit 4 is configured according to the invention to include the sensed ambient temperature UT in the fire analysis. It is thereby possible to detect a fire even more reliably in the sense of a multi-criteria fire detector. In the present example, the third A/D converter 53 converts the temperature signal TS output by the thermistor 5 into digital temperature values T, which are then included as well in the fire analysis by the logic block 40 of the control unit 4.

Figure 14:
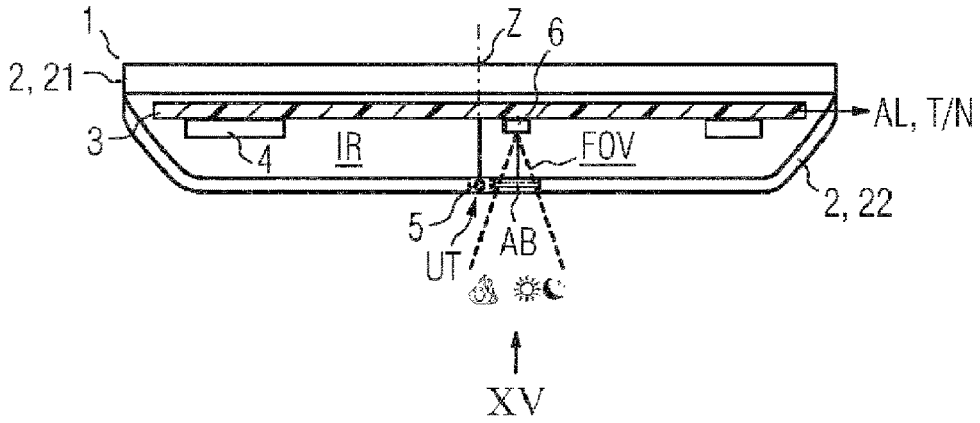
FIG. 14 shows in a sectional view an example of a thermal detector having a temperature sensor and having a photodiode for ambient light for detecting open fire incorporating teachings of the present disclosure.

FIG. 14 shows in a sectional view an example of a thermal detector 1 having a temperature sensor 5 and having a photodiode 6 for sensing ambient light for detecting open fire according to the invention. In the present example, the detector 1 comprises a housing 2 composed of a base element 21 and a detector cover 22. The detector 1 can then be attached by the base element 21 to a detector base mounted on a ceiling. Both housing parts 21, 22 are typically made from a light-tight plastics housing. In the detector cover 22 is provided a central aperture, in which a thermistor 5 as the temperature sensor is mounted such that it is protected from potential mechanical influences. Arranging centrally allows omnidirectional sensing of the ambient temperature UT in the immediate surroundings of the detector 1 (see also FIG. 15). In the interior IR of the detector 1 is also housed a circuit mount 3, on which is arranged, in addition to a microcontroller 4 as a control unit, also the photodiode 6. Located opposite the photodiode 6 is an opening AN in the detector cover 22, through which the photodiode 6 can "see" into the region surrounding the detector 1. FOV denotes the associated optical detection region of the photodiode 6. The photodiode 6 can then optically detect open fire in this detection region FOV, symbolized by a flame icon. In the present example, the opening AN in the detector cover 22 is equipped with a transparent cap AB to protect against dirt. The cap AB may comprise a light-transmissive plastics material. It can also already be equipped with a daylight filter, or comprise same. In the case of a fire being detected, a fire alarm AL can be output, as can a day/night identifier T/N, symbolized by an arrow.

Figure 15:
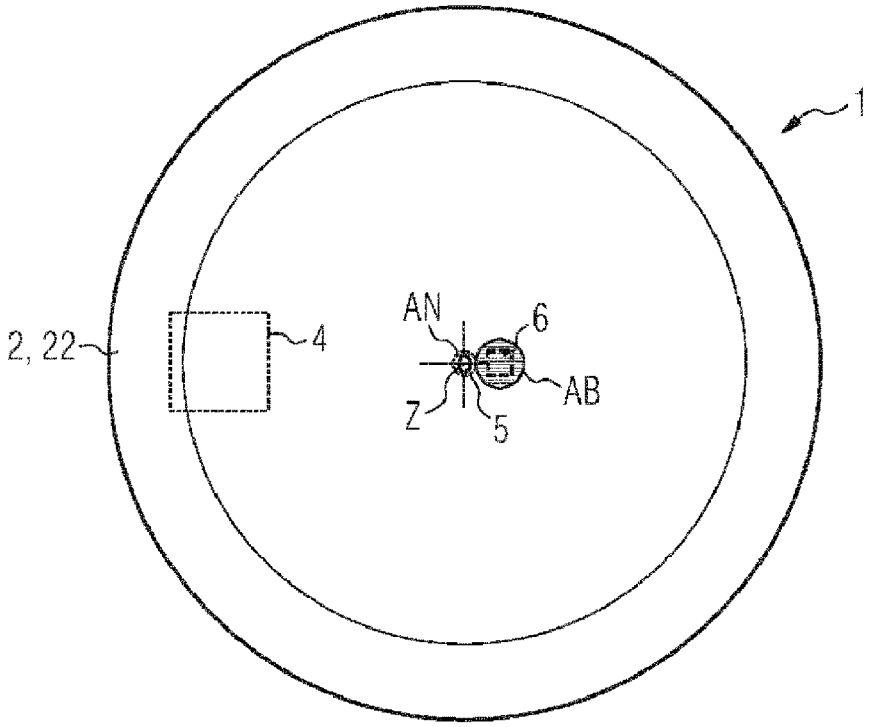
FIG. 15 shows the example of FIG. 14 in a plan view and in the viewing direction XIV therein.

FIG. 15 shows the example of FIG. 14 in a plan view along the viewing direction indicated in FIG. 14. Z denotes the geometric central main axis of the detector 1. In some embodiments, the control unit 4 is configured to analyze a photo-signal received from the photodiode 6 for the presence of flicker frequencies characteristic of open fire, and on the basis thereof, to output a potential fire alarm more quickly. It is also configured to monitor the photo-signal for being above or below a minimum brightness level and to output same as a day/night identifier T/N, symbolized by a sun and moon icon, for instance to a higher-level control center.

Figure 16:
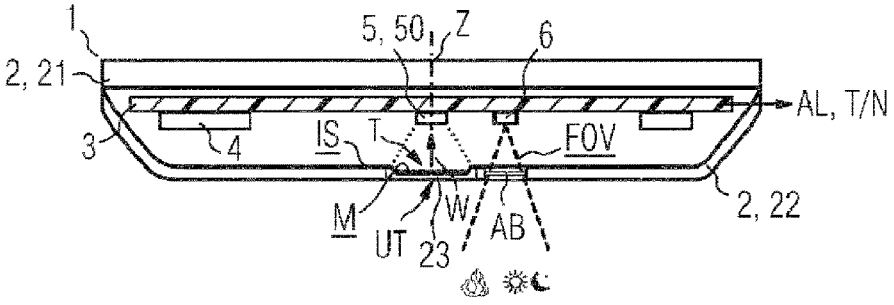
FIG. 16 shows a first embodiment of the fire detector incorporating teachings of the present disclosure comprising a non-contact temperature sensor comprising a thermopile sensitive to thermal radiation in the infrared region as a thermal radiation sensor.

FIG. 16 shows a first embodiment of the fire detector 1 incorporating teachings of the present disclosure comprising a non-contact temperature sensor 5 comprising a thermopile 50 sensitive to thermal radiation W in the infrared region as a thermal radiation sensor. Unlike the previous embodiment, the thermopile 50 is arranged in the detector housing 2 on the circuit mount 3 and oriented optically towards the internal face IS of the detector cover 22 for the purpose of sensing the ambient temperature UT. The optically detected surface on the internal face IS of the detector cover 22 is denoted in FIG. 16 as the measurement surface M. In some embodiments, the thermopile 50 is again arranged centrally in the detector housing 2 in order to facilitate as omnidirectional sensing as possible of the ambient temperature UT in the immediate surroundings of the detector 1. The detector cover 22 in the central region 23 of the internal face IS is here designed for thermal conduction with an opposite region of the external face of the detector cover 22 such that the housing temperature T that arises on the internal face IS tracks the ambient temperature UT on the opposite region of the detector cover 22. In the simplest case, the wall thickness in the central region 23 can be reduced, for instance to half a millimeter. In some embodiments, this central region 23 can be thermally insulated from the rest of the surrounding detector cover 22. In most cases, a change in the wall thickness of the detector cover 22 will not be necessary.

The current ambient temperature UT or the housing temperature T that tracks this temperature, is derived by calculation according to the pyrometric measurement principle from the thermal radiation value sensed by the thermal radiation sensor 50. In this derivation, the emissivity for the thermal radiation W of the measurement surface M is input to the calculation. This value can be determined by measurement and typically lies in the range of 0.75 to 0.9. It holds here that the blacker the measurement surface, the higher the emissivity. An emissivity of 1.0 corresponds to the maximum theoretically achievable value for a black-body radiator.

The calculation can be performed by a microcontroller integrated in the thermopile 50, which microcontroller outputs the currently calculated temperature value and hence constitutes a non-contact temperature sensor. In some embodiments, the thermopile 50 can merely output an instantaneous thermal radiation value, which then is captured by the microcontroller 4 of the fire detector 1 and processed further for the purpose of calculating the current temperature value. The associated emissivity may be stored in the microcontroller 4 for this purpose.

Figure 17:
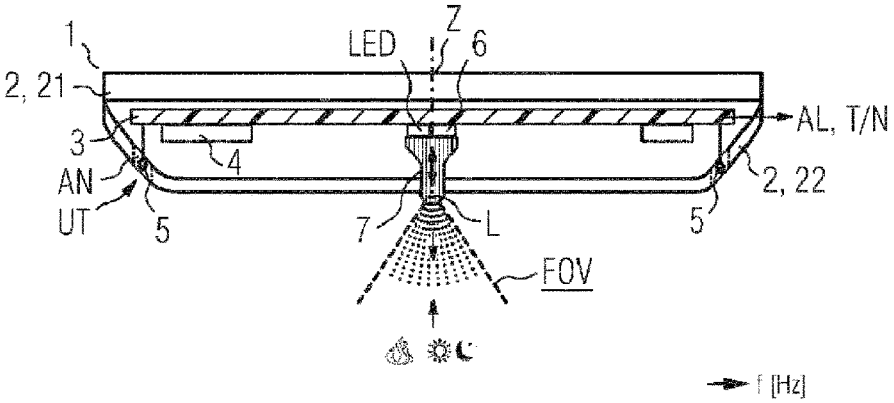
FIG. 17 shows a second embodiment of the fire detector incorporating teachings of the present disclosure comprising a common light guide for sensing ambient light by means of the photodiode and as an indicator in the sense of an operational indicator.

FIG. 17 shows a second embodiment of the fire detector 1 incorporating teachings of the present disclosure having a common light guide 7 for sensing ambient light by means of the photodiode 6 and as an indicator in the sense of an operational indicator. For this purpose, an indicator light emitting diode LED may be arranged adjacent to the photodiode 6 on the circuit mount 6. The light guide 7 is such that at a first end it faces both the indicator light emitting diode LED and the photodiode 6. The second end of the light guide 7 may extend through a central opening in the detector cover 22. The photodiode 6 can thereby detect ambient light through the light guide 7. Independently thereof, in the opposite direction, light from the indicator light emitting diode LED can be coupled through the light guide 7 and out at the second end of the light guide 7. The indicator light emitting diode LED is typically driven periodically to emit an optically visible pulse, for instance every 30 seconds, for the operational indicator of the fire detector 1. In particular, the second end of the light guide 7 is embodied as an optical lens L. This makes it possible to detect ambient light from a larger optical detection region FOV. Furthermore, the operational indicator of the fire detector 1 is visible in a larger solid-angle range. The light guide 7 may comprise a single piece from a transparent plastics material. The photodiode 6 may comprise a silicon photodiode and in particular a silicon PIN photodiode.

Figure 20:
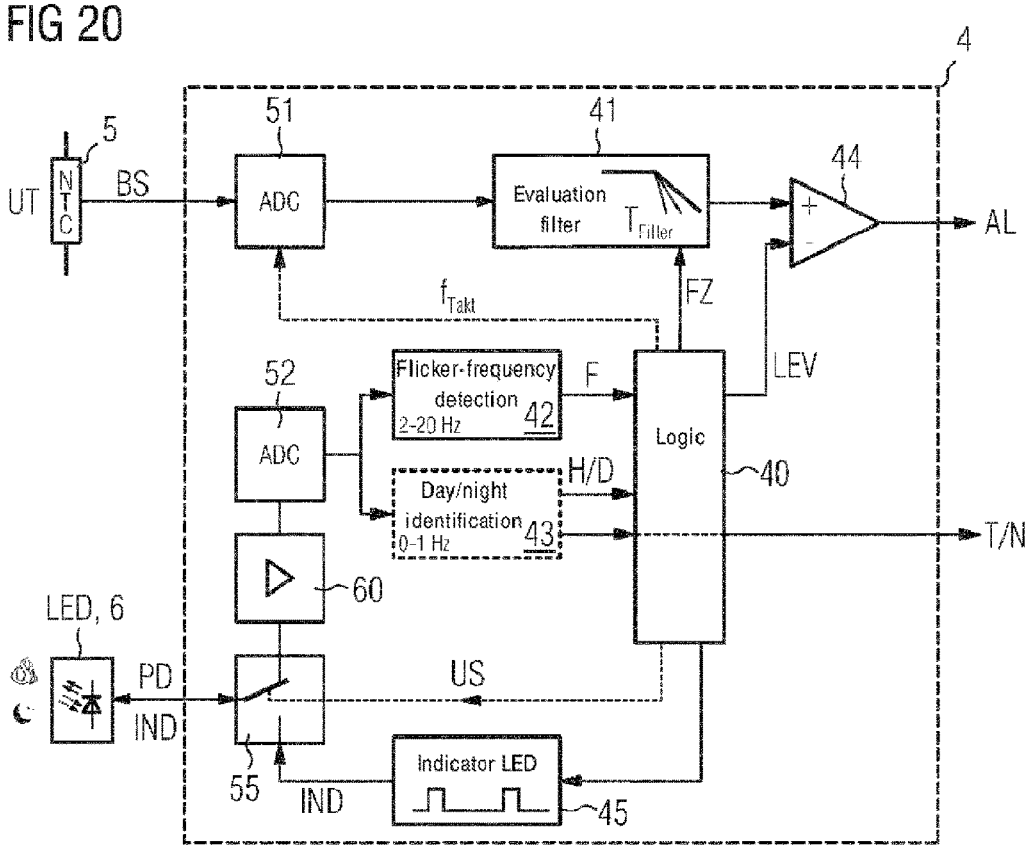
FIG. 20 shows a third functional block diagram of a detector control unit, additionally for alternately driving an indicator light emitting diode and sensing the ambient light by means of the indicator light emitting diode LED, switched in an operating mode as a photodiode, incorporating teachings of the present disclosure.

In some embodiments, it is possible to dispense with such a photodiode made specifically for light detection. In this case, the light guide 7 faces by its first end only the indicator light emitting diode LED. The LED light is again coupled out at the second end of the light guide 7 into the surroundings of the fire detector 1. In some embodiments, the indicator light emitting diode LED is now provided for ambient-light detection, because in principle every light emitting diode is also suitable for detecting ambient light, although with far lower efficiency. In this case, the indicator light emitting diode LED is switched alternately into an operating mode for light generation and into an operating mode as a photodiode (the following explanation for FIG. 20 provides further details). Unlike FIG. 14 and FIG. 16, the fire detector 1 comprises by way of example two oppositely located temperature sensors 5 for sensing the ambient temperature UT.

Figure 18:
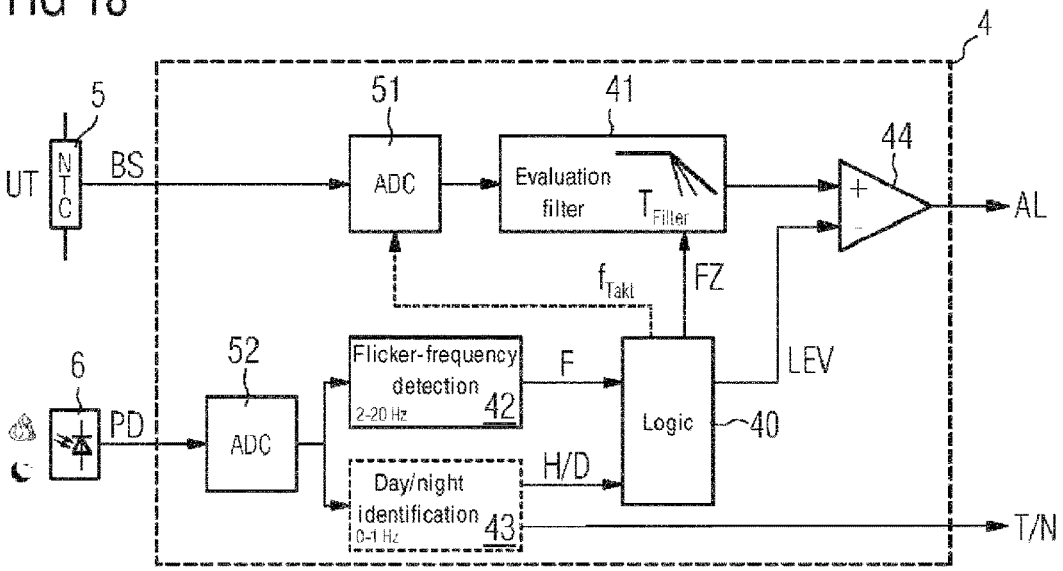
FIG. 18 shows a functional block diagram of a detector control unit comprising an evaluation filter having an adjustable time constant for outputting a potential fire alarm more quickly incorporating teachings of the present disclosure.

FIG. 18 shows a functional block diagram of a detector control unit 4 comprising an evaluation filter 41 having an adjustable filter time for outputting a potential fire alarm more quickly. The function blocks 40-44 shown may be implemented as software, i.e. as program routines, which are executed by a processor-based control unit, for instance by a microcontroller. The program routines are loaded in a memory of the microcontroller 4. The memory may comprise a non-volatile electronic memory such as a flash memory, for instance. The microcontroller 4 may additionally comprise specific function blocks that are already integrated as hardware function units in the microcontroller 4, for instance units such as analog-to-digital converters 51, 52, signal processors, digital input/output units and bus interfaces.

In the present example, the microcontroller 4 comprises two analog-to-digital converters 51, 52 for digitizing a current temperature signal BS from the fire sensor 5, i.e. in this example from an NTC, and a photo-signal PD from a photodiode 6. The digitized temperature signal is then fed along the thermal path to a (digital) evaluation filter 41. The evaluation filter 41 may comprise a digital low-pass filter, which performs a certain degree of signal-smoothing or averaging. This filtering, however, results in a delayed filter response at the output of the evaluation filter 41 similar to a filter time constant for a low-pass filter. The output signal (not described further) from the evaluation filter 41 is then fed to a comparator 44, which compares this signal with an alerting threshold LEV, for instance with a temperature value of 65°. If the filter output signal exceeds this comparative value LEV, then a fire alarm AL is output, for instance to a higher-level central fire-alarm system.

In some embodiments, the microcontroller 4 is also configured to analyze the photo-signal PD received from the photodiode 6 for the presence of flicker frequencies characteristic of open fire, and on the basis thereof, to output a potential fire alarm more quickly. The spectral signal analysis can be performed, for example, by a digital Fourier transform or by wavelet analysis. This is achieved technically by the flicker-frequency detector function block 42. In the event of flickering fire being detected, this function block outputs a flicker indicator F to a logic block 40, which thereupon increases the sampling rate $f_{Takt}$ of the A/D converter 51 for digitizing the temperature signal BS and/or reduces the filter time constant $T_{Filter}$. The flicker indicator F may be, for example, a binary value, for instance 0 or 1, or a digital value, for instance in the range of 0 to 9. The value 0, for the binary case, can represent, for instance, that flicker frequencies are not present, and the value 1 correspondingly that they are present. In the digital case, the value 0 can represent, for instance, that flicker frequencies are not present. The values 1 to 9 can indicate, for example, that flicker frequencies are present, with high numerical values indicating high flicker-frequency levels and low numerical values indicating low flicker-frequency levels. By increasing the sampling rate $f_{Takt}$, the digitized temperature signal BS is available more quickly at the evaluation filter 41 for further processing. In some embodiments, by reducing the filter time constant $T_{Filter}$, the evaluation filter 41 responds more quickly, and therefore an actual rise in the temperature signal BS also results in giving a fire alarm AL more quickly. Increasing the sampling rate $f_{Takt}$ and/or reducing the filter time constant $T_{Filter}$ can, for instance for the digital case of the flicker indicator F, be performed according to the value range of the indicator.

In some embodiments, the logic block 40 can be programmed such that the alerting threshold LEV is lowered, for instance from 65° to 60°. For the fire situation that is more likely to be occurring on the basis of the detected flicker frequency, this results in a fire alarm being output more quickly.

In some embodiments, the logic block 40 can also be programmed to lower the alerting threshold LEV in particular when a light/dark indicator H/D, which is provided by the function block 43 of the microcontroller 4, falls below a minimum brightness level, for instance below a value of 1 lux. This example value corresponds to a dark to heavy dusk environment. Fewer thermal disturbances from the detector surroundings can be expected in such an environment than during the day, for instance disturbances such as the temperature fluctuations mentioned in the introduction. The assumption of fewer disturbances from the detector surroundings allows the alerting threshold LEV to be lowered. The more sensitive setting results in a fire alarm being output more quickly because the output signal from the evaluation filter 41 now exceeds the lowered alerting threshold LEV more quickly. The day/night identification is performed by low-pass filtering of the photo-signal PD with a time constant of less than 1 Hz, in particular of less than 0.1 Hz.

Figure 19:
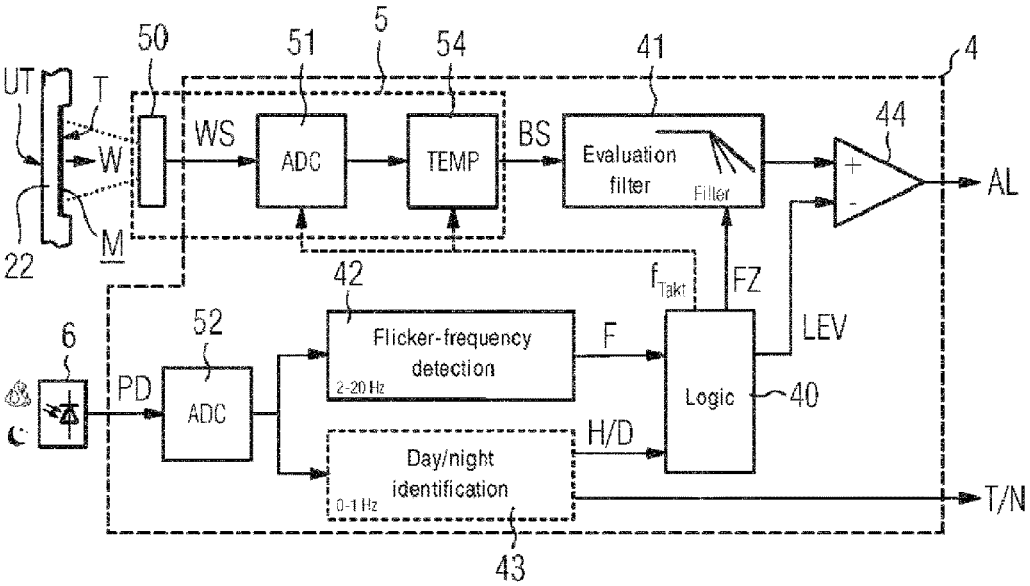
FIG. 19 shows a second functional block diagram of a detector control unit comprising a temperature sensor comprising a thermopile incorporating teachings of the present disclosure.

FIG. 19 shows a second functional block diagram of a detector control unit 4 comprising a temperature sensor 5 comprising a thermopile 50 incorporating teachings of the present disclosure. Unlike the previous embodiment, the current ambient temperature UT or the housing temperature T that tracks this temperature is determined by a temperature calculation block 54 of the microcontroller 4. The latter is supplied with a digitized thermal signal WS via an A/D converter 51 from a thermopile 50 as an example of a thermal radiation sensor. In determining the temperature by calculation, the emissivity for the thermal radiation W in the infrared region of the measurement surface M is input to the calculation.

FIG. 20 shows a third functional block diagram of a detector control unit 4, additionally for alternately driving an indicator light emitting diode LED and sensing the ambient light by means of the indicator light emitting diode LED, switched in an operating mode as a photodiode 5, incorporating teachings of the present disclosure. Unlike the previous FIG. 18, the logic block 40 uses a switchover signal US to control a switchover unit 55 alternately so that in a first phase, the indicator light emitting diode LED can be driven to light up briefly by a current signal IND from a pulse generator 45, for instance every 30 seconds. In a second phase, the logic block 40 controls the switchover unit 55 such that the low photo-signal PD from the indicator light emitting diode LED is fed to an amplifier 60. This is followed in turn by an A/D converter 52 for digitizing the photo-signal PD. The amplifier 60 may comprise a transimpedance amplifier.

LIST OF REFERENCE CHARACTERS

1 Fire detector, open light-scattering smoke detector, closed light-scattering smoke detector, thermal detector, heat detector, point-type detector
2 housing, plastics housing
3 circuit mount, printed circuit board
4 control unit, microcontroller
5 temperature sensor, thermistor, NTC, temperature sensor

6 (separate) photodiode, IR photodiode, silicon PIN photodiode
6' common photodiode, IR photodiode, silicon PIN photodiode
7 light guide
10 fire sensor, optical measuring chamber, labyrinth
11 detector base
21 base element
22 detector cover, housing cover
23 central housing part
40 function block, logic block
41 function block, evaluation filter
42 function block, flicker-frequency detector
43 function block, night-identification block
44 function block, comparator
45 function block, pulse generator
46 function block, frequency generator, HF-burst generator
47 function block, brightness compensator
50 thermopile
51-53 A/D converter, analog-to-digital converter
54 temperature calculation block
55 switchover unit, multiplexer
56, 57 frequency filter, digital filter, high-pass filter, low-pass filter
60-63 amplifier, transimpedance amplifier
A amplitude, signal amplitude
AB cap, transparent cap, window
AC scattered-light signal/photo-signal without DC component
AL fire alarm, alarm signal, alarm information
AN opening, cutout, hole
BS sensor signal, fire sensor signal, scattered-light signal, temperature signal
BS' filtered scattered-light signal
E light receiver, photosensor, photodiode
F flicker indicator
FZ filter time adjustment signal, adjustment signal f frequency
FOV detection region, field of view
$f_{Takt}$, $f_{Takt2}$ clock signal, second clock signal
GAIN gain
H/D second DC component, light/dark indicator
L lens, optical lens
LED indicator LED
LEV alerting threshold
N mesh, insect shield, grille
OF housing aperture, smoke entry aperture
PD photo-signal, photodiode signal
RA, RA' control error
S light transmitter, optical transmitter, light emitting diode
$S_{Rel}$ relative spectral sensitivity
SA light-scattering arrangement
SZ light-scattering center, measurement volume
t time, time axis
T temperature value
TS temperature sensor signal
T/N day/night identifier
$T_{Filter}$ filter time, filter time constant
UT ambient temperature
Z main axis, axis of symmetry
A light wavelength

What is claimed is:

1. A fire detector comprising:
a fire sensor generating a signal corresponding to a characteristic fire parameter;
a control unit; and
a photodiode for detecting ambient light in a spectrally delimited range of 400 nm to 1150 nm;
wherein the control unit analyzes the signal;
the control unit generates a fire alarm if the signal corresponds to a predetermined threshold for a fire;
the control unit analyzes a photo-signal received from the photodiode to detect flicker frequencies characteristic of open fire; and
if the flicker frequencies characteristic of open fire are detected, the control unit increases a sampling rate for acquiring the sensor signal from the fire sensor by reducing a filter time of an evaluation filter for the fire analysis and/or by lowering an alerting threshold.

2. The tire detector as claimed in claim 1, wherein the control unit suppresses generation of the fire alarm based on detected characteristic flicker frequencies in the received photo-signal.

3. The fire detector as claimed in claim 1, wherein the photodiode is comprises a silicon photodiode.

4. The fire detector as claimed in claim 1, further comprising a daylight blocking filter that passes only light in a range of 700 nm to 1150 nm arranged in front of the photodiode.

5. The fire detector as claimed in claim 1, further comprising: a housing; a circuit mount; a light transmitter disposed in the housing; and a light receiver disposed in the housing; wherein the light transmitter and the light receiver are arranged in a light-scattering arrangement having a light-scattering center located outside the light-scattering smoke detector; and the control unit analyzes a scattered-light signal received from the fire sensor as the sensor signal for an inadmissibly high signal level as a fire parameter and/or for an inadmissibly high rate of rise of the sensor signal as another fire parameter, and generates the fire alarm in the event of a fire being detected.

6. The fire detector as claimed in claim 5, wherein the light receiver for detecting scattered-light and the photodiode comprise a common photodiode.

7. The fire detector as claimed in claim 6, wherein: the control unit analyzes in time-separated phases the scattered-light signal/photo-signal received from the common photodiode; and the control unit analyzes the received scattered-light signal/photo-signal in a first phase for the inadmissibly high signal level and/or for the inadmissibly high rate of rise; and the control unit analyzes the received scattered-light signal/photo-signal in a particular second phase for the presence of characteristic flicker frequencies.

8. The fire detector as claimed in claim 5, wherein the control unit determines a first DC component from the received scattered-light signal/photo-signal, and subtracts the first DC component from the received scattered-light signal/photo-signal to obtain a scattered-light signal/photo-signal that contains substantially no DC component.

9. The fire detector as claimed in claim 8, wherein the control unit compares the determined first DC component with a specified overdrive value, and generates a fault signal if the determined first DC component exceeds the overdrive value for a specified minimum time.

10. The fire detector as claimed in claim 5, wherein: the control unit determines a second DC component from the received scattered-light signal/photo-signal, the second DC component representing a long-term average of a brightness value; and the control unit monitors the second DC component and lowers the alerting threshold if the second DC component falls below a minimum brightness level.

11. The fire detector as claimed in claim 1 further comprising an optical measuring chamber arranged in a detector housing, shielded from ambient light, and permeable to smoke; wherein the control unit analyzes a scattered-light signal received from the optical measuring chamber as the sensor signal for an inadmissibly high signal level as a fire parameter and/or for an inadmissibly high rate of rise of the sensor signal as another fire parameter, and generates the fire alarm in the event of a fire being detected.

12. The fire detector as claimed in claim 1, further comprising a temperature sensor for sensing an ambient temperature in a region immediately around the fire detector; and wherein the control unit includes the sensed ambient temperature in a fire analysis.

13. The fire detector as claimed in claim 1 further comprising a temperature sensor; wherein the control unit analyzes a temperature signal received from the temperature sensor as the sensor signal for an inadmissibly high ambient temperature as a fire parameter and/or for an inadmissibly high temperature rise as another fire parameter, and generates the fire alarm in the event of a fire being detected.

14. The fire detector as claimed in claim 13, wherein the temperature sensor comprises a non-contact temperature sensor having a thermal radiation sensor sensitive to thermal radiation in an infrared region; and the fire detector further comprises a detector housing having a detector cover; wherein the thermal radiation sensor is arranged in the detector housing and is oriented optically towards an internal face of the detector cover; and the detector cover in the region of the internal face is designed for thermal conduction with an opposite region of an external face of the detector cover such that the housing temperature that arises on the internal face tracks the ambient temperature on the opposite region of the detector cover.

15. The fire detector as claimed in claim 1, wherein the control unit lowers an alerting threshold for generating a potential fire alarm to emit the potential fire alarm more quickly if the presence of flicker frequencies characteristic of open fire has been detected.

16. The fire detector as claimed in claim 11, wherein the control unit monitors whether the photo-signal output by the photodiode falls below a minimum brightness level, and in response, lowers the alerting threshold for the output of a potential fire alarm.

17. The fire detector as claimed in claim 16, further comprising a connection to a higher-level control center; and wherein the control unit notifies the control center whether the brightness is above or below the minimum brightness level as a day/night identifier.

* * * * *